United States Patent [19]

Goida

[11] 4,270,856

[45] Jun. 2, 1981

[54] CONVERSION KIT FOR PHOTOCOPYING MACHINE

[75] Inventor: John H. Goida, Princeton, N.J.

[73] Assignee: Applied Copy Technology, Inc., Princeton Junction, N.J.

[21] Appl. No.: 3,887

[22] Filed: Jan. 16, 1979

Related U.S. Application Data

[63] Continuation-in-part of Ser. No. 799,398, May 23, 1978, abandoned.

[51] Int. Cl.[3] ..... G03G 15/00

[52] U.S. Cl. ..... 355/3 R; 355/10; 355/77

[58] Field of Search ..... 355/3 R, 10, 8, 11, 355/77

[56] References Cited

U.S. PATENT DOCUMENTS

| | | | |
|---|---|---|---|
| 3,600,082 | 8/1971 | Knechtel | 355/8 |
| 3,600,083 | 8/1971 | Leedom | 355/10 |
| 3,608,523 | 9/1971 | Jeffery et al. | 118/662 |
| 3,698,804 | 10/1972 | Cranskens et al. | 355/11 X |
| 3,770,345 | 11/1973 | Kawakubo et al. | 355/3 DR |
| 3,820,891 | 6/1974 | Kurakawa | 118/652 X |
| 3,955,889 | 5/1976 | Ishiguro et al. | 355/3 R |
| 3,966,316 | 6/1976 | Pfeifer et al. | 355/3 DR |
| 3,985,436 | 10/1976 | Tanaka et al. | 355/3 DD |
| 4,032,229 | 6/1977 | Tani et al. | 355/10 X |

*Primary Examiner*—R. L. Moses

*Attorney, Agent, or Firm*—Richard C. Woodbridge

[57] ABSTRACT

A conversion kit is employed to convert a paper roll fed, positive liquid toner, coated paper photocopying machine into a negative liquid toner bond paper photocopying machine. Most basic elements of the kit are mounted on a frame which is adapted to be received by the chassis of the pre-existing positive liquid toner photocopying machine. The basic elements of the kit include an image projection system, a selenium drum, a drum drive mechanism, a liquid toner delivery system, a charge, discharge corona bar and a transfer corona bar. Other elements of the kit and further features of the invention are fully described in the specification. The purpose of the invention is to combine the economies of existing roll fed photocopying machines with the reliability of modern liquid toner plane paper copying systems.

12 Claims, 32 Drawing Figures

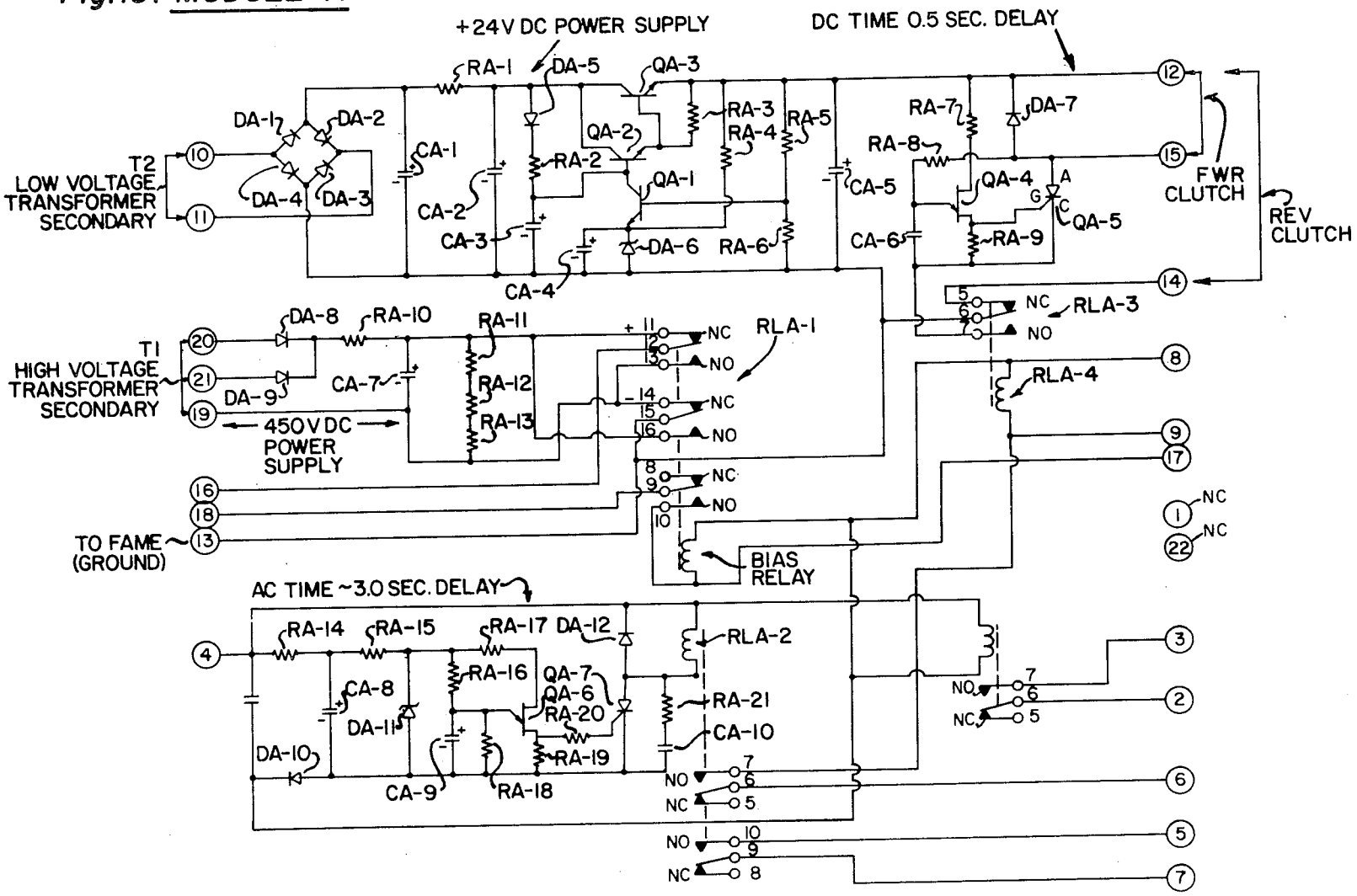
Fig. 13. MODULE-A

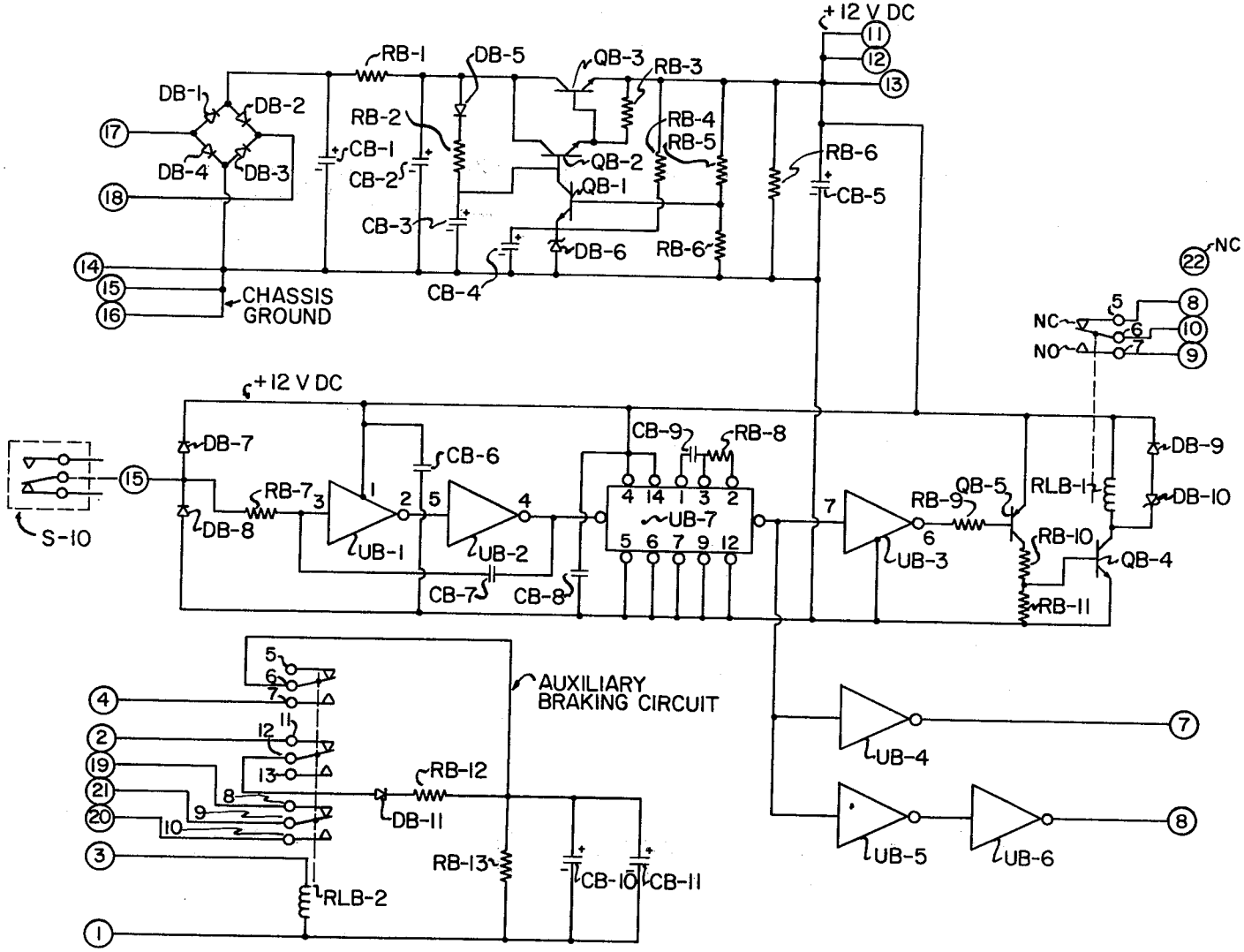
Fig. 14. MODULE-B

CONVERSION KIT FOR PHOTOCOPYING MACHINE

CROSS-REFERENCE TO RELATED APPLICATIONS

This invention represents an improvement over the invention described in and this application is a continuation-in-part of my copending application entitled "Conversion Kit for Photocopying Machine", Ser. No. 799,398 filed on May 23, 1978, now abondoned.

BACKGROUND OF THE INVENTION

1. Field of the Invention

This invention relates to the photocopying art in general and, more particularly, to a conversion kit for converting a coated paper, roll fed, positive liquid toner photocopying machine into a negative liquid toner, plain paper photocopying machine.

2. Description of the Prior Art

The use of paper roll fed, positive liquid toner photocopying machines is well known to those of ordinary skill in the art. Examples of such machines include the Olivetti Line Models 514, 515, 520, 614 and 614R. These prior art machines are frequently used as office copiers or as coin operated machines in public places. Much Olivetti office equipment is believed to be manufactured by the Olivetti Corporation of America, 500 Park Avenue, New York, N.Y., which is a wholly owned subsidiary of Ing. C. Olivetti & Company of Italy. Roll fed machines the especially attractive to coin operated photocopying operations because they require less maintenance and further because there is less waste due to the fact that the length of the photocopy can be varied to suit the length of the original. Accordingly, roll fed photocopying machines are preferred by the photocopy machine maintenance industry. One disadvantage of conventional roll fed machines is that they are combined with positive liquid toner and coated paper reproduction processes. Typically the image is placed directly upon the zinc oxide coated paper and not upon a drum as is usually done with dry copiers. Coated paper is unattractive for use with coin operated machines because it has an unpleasant feel and is generally more expensive. Many modern photocopying systems use a liquid toner, plain paper process because it is much more effective and reliable. Modern wet or liquid toner processes are also attractive because specially treated paper is not required under normal operating conditions. Examples of typical modern liquid toner photocopying machines include the Savin Models 750, 770 and 780 and the Saxon Models Number 1, 2, and 3. Saxon equipment is sold by Saxon Business Products, Inc., 13900 N.W. 57th Court, Miami Lakes, FL 33014. Savin ® is a registered trademark of the Savin Business Machines Corporation and Savin products are believed to be distributed in the United States by the Savin Business Machines Corporation, Valhalla, N.Y.

In view of the foregoing there is a clear need for paper roll feed, liquid toner plain paper photocopying machines is such equipment can be manufactured cheaply and economically for the office copier and coin operated market. It is not believed that the economies of the coin operated photocopying market are such as to make the manufacture of such special liquid toner machinery justifiable in view of the size of the market involved. Even if such new machinery were available, it would displace already existing photocopying equipment and therefore might make the purchase of such new equipment less attractive. Part of this invention includes the discovery that some existing paper roll fed, positive liquid toner photocopying machines can be economically and efficiently converted to negative liquid toner machinery by unique conversion equipment.

SUMMARY OF THE INVENTION

Briefly described the invention comprises a kit for converting an office or coin operated, coated paper roll fed, positive liquid toner photocopying machine into a negative liquid toner, plain paper photocopying machine. The basic kit includes a frame for mounting most of the elements of the kit, an image projection system for projecting the image of the objet to be copied, a selenium drum for receiving the image from the projection means, a liquid toner delivery system for providing liquid toner to the drum, and a corona transfer means for transferring the toner from the selenium drum to the paper. The kit further includes a variety of other specific elements which are associated with the basic elements of the kit. The frame is adapted to be received in the chassis of an existing conventional paper roll fed photocopying machine.

It has been found that wet toner systems are more reliable and easier to maintain than dry toner systems. It is also known that paper roll stock is up to 50% less expensive than precut, pretreated photocopying paper. The purpose of the invention is to take advantage of the paper economies of existing paper roll-fed copying machinery along with the advantages of modern liquid toner, plain paper photocopying systems. These and other aspects of the invention will be more fully understood with reference to the drawings.

BRIEF DESCRIPTION OF THE DRAWINGS

FIGS. 13 and 14 are detailed electrical schematics of Modules A and b respectively as illustrated in the schematic of FIGS. 12A and 12B.

DETAILED DESCRIPTION OF THE INVENTION

During the course of this description, like numbers will be used to indicate like elements according to the different views of the invention.

Figure 1:
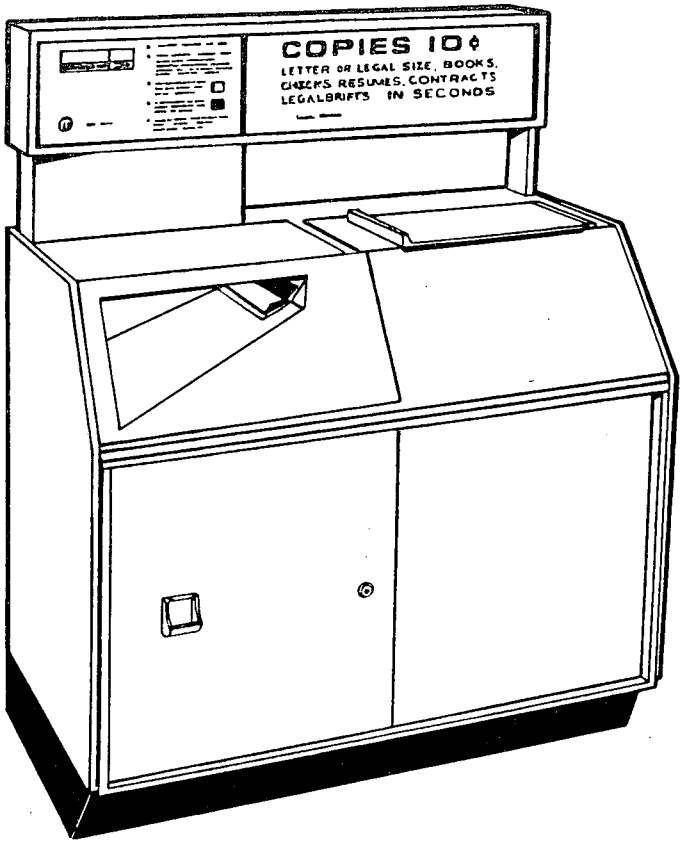
Fig. 1. PRIOR ART
FIG. 1 is an exterior perspective view of an Olivetti Coinfax Model 520 prior art coin operated, roll fed, positive liquid toner photocopying machine.

A typical prior art coin operated, coated paper roll fed, positive liquid toner photocopying machine is illustrated in FIG. 1. The specific machine illustrated in FIG. 1 is a COINFAX Model 520 photocopier manufactured by the Olivetti Corporation of America, 500 Park Avenue New York, New York. Such machines are widely used on college campuses, in public libraries, and at other locations where inexpensive, high volume photocopying takes place. One major feature of such prior art machinery is that it operates from coated, roll fed, paper stock. The length of the copy can be manually adjusted to correspond to the length of the original. In this manner there is no significant paper waste. Additionally, it is mechanically simpler to work from roll fed paper because it does not require any special sheet pick-up mechanism. It is also possible to produce more copies from a roll fed machine due to the greater volume of paper on the roll. In addition to the Model 520, the Olivetti Models 514, 515, 614 and 614R also enjoy widespread usage in the trade.

Figure 2:
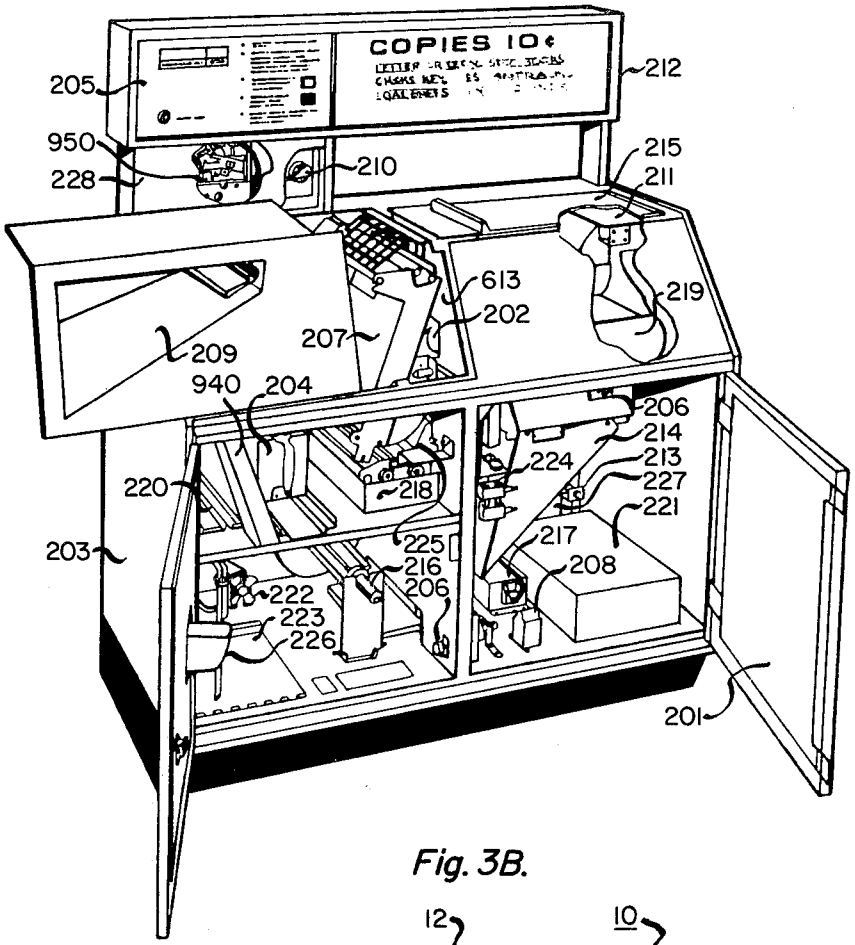
Fig. 2. PRIOR ART
FIG. 2 is an interior perspective view of the prior art machine shown in FIG. 1.

The major parts of the Olivetti Model 520 prior art photocopying machine are illustrated in a cut-away perspective view of FIG. 2. The following items are well known to those of ordinary skill-in-the-art. The major prior art items include:

| Element No. | Description |
|---|---|
| 201 | Access Door Assembly |
| 202 | Air Blower |
| 203 | Cabinet Assembly |
| 204 | Coin Box Assembly |
| 205 | Control Panel |
| 206 | Control Switches |
| 207 | Conveyor |
| 208 | Copy Counter |
| 209 | Exit Tray |
| 210 | Exposure Timer |
| 211 | Flap and Solenoid Assembly |
| 212 | Illuminated Sign Assembly |
| 213 | Master Switch and Fuse |
| 214 | Optics (i.e. optical system) |
| 215 | Area for Copy Original |
| 216 | Paper Spindle |
| 217 | Power Supply |
| 218 | Processor and Toner Tray |
| 219 | Reflectors and Lamps |
| 220 | Refresher Assembly |
| 221 | Relay Chassis |
| 222 | Toner Pump and Tubing |
| 223 | Toner Scale |
| 224 | Transport, Corona Bracket & Motor |
| 225 | Turn Around Paper Guide |
| 226 | Coin Return Cup |
| 227 | Heater and Humidistat |
| 228 | Left Pedestal Assembly |
| 613 | Center Support Element |
| 940 | Coin Return Chute |

Details of Items 202, 207, 211, 214, 217, 218, 219, 224 and 225 are illustrated in FIGS. 11A through 11I. In order to convert the Ollivetti Model 520 machine it is first necessary to remove some or all of the elements described in FIGS. 11A through 11I. The retained and removed items are described in detail in a subsequent portion of this disclosure. Similarly, the electrical schematic of the prior art Model 520 illustrated in FIGS. 1 and 2 is shown schematically in FIGS. 10A and 10B and will be discussed subsequently. The coin mechanism shown in FIS. 15A and 15B will be discussed at the end of the disclosure since it is common to both the converted and unconverted photocopier.

Since the advent of prior art photocopying machines such as illustrated in FIGS. 1 and 2, there have been improvements made in the toner systems which have made photocopying machines more effective and reliable. In particular, the advent of liquid toner systems such as employed in the Savin 750, 770 and 780 machines have proven to be quite attractive. It became apparent that there was a need for coin operated photocopying machinery having the economies of a roll fed device and the reliability and effectiveness of a liquid toner system device. Unfortunately, the coin operated photocopying machinery market is believed to be too small to justify the production of additional machinery to replace the older machinery. In addition, it is not believed economical to replace the prior art machinery altogether due to the heavy initial capital investments required.

Figure 3B:
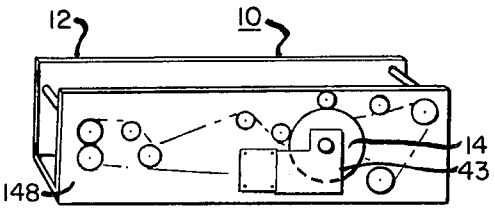
FIGS. 3A and 3B are undetailed front and back perspective views of the frame of conversion kit according to the preferred embodiment thereof.
Figure 3A:
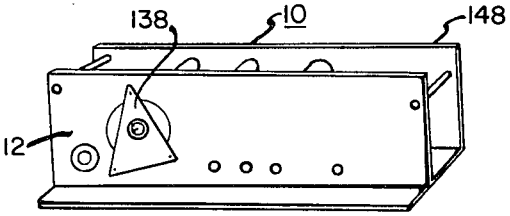

It has been found that the conversion kit 10 illustrated in FIGS. 3A and 3B above is an acceptable solution to the problem. The kit 10 includes most of the basic elements of an improved liquid toner system and is adapted to be readily received in the chassis of a typical prior art photocopying machine such as the Olivetti Model 520 illustrated in FIGS. 1 and 2 above.

Figure 7:
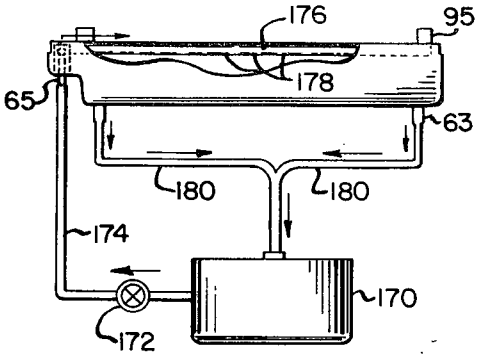
FIG. 7 is a schematic illustration of the recirculating wet toner system.
Figure 9:
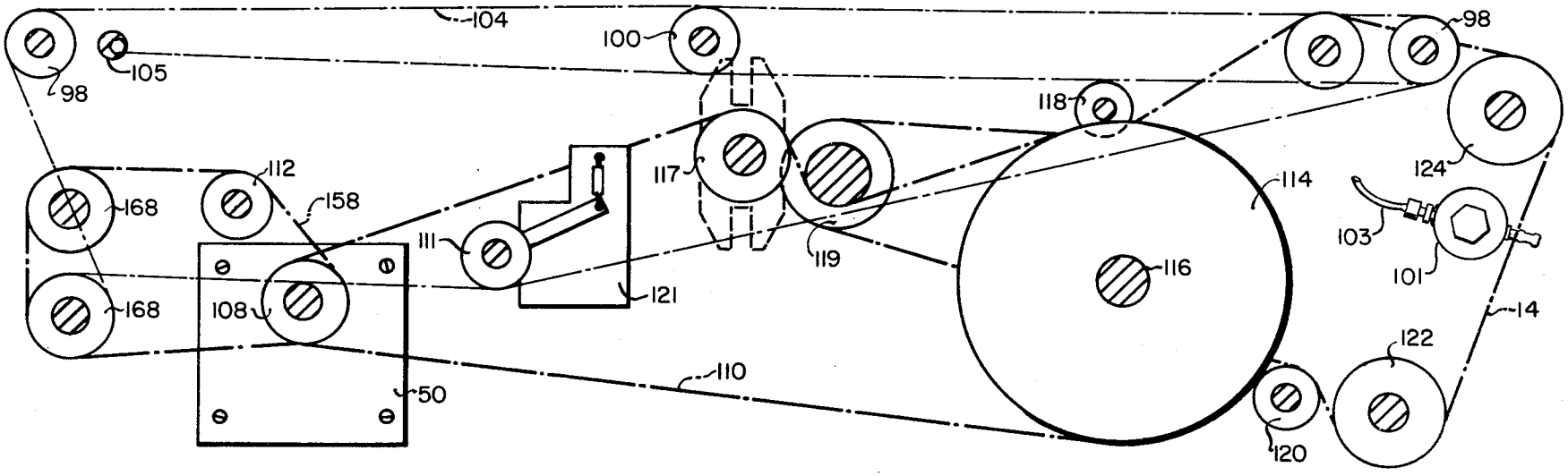
FIG. 9 is a drive train schematic of the conversion kit as seen from the rear.

The kit 10 is illustrated from the front in FIG. 3A. This is the view that one would have of the kit 10 when facing the photocoping machine from the front side. The rear view of the kit 10 is illustrated in FIG. 3B. The most prominent features visible in FIGS. 3A and 3B are the frame 12 and the drive system 14 which includes a plurality of gear sprockets and drive chains. The drive system 14 is illustrated in more detail in FIG. 9. Also visible in FIG. 3A is the front triangular shaped mounting plate 138 attached to side frame 12. An L-shaped plate 43 shown in FIG. 3B is attached to rear side frame 148 and supports the opposite side of drum 18. Most of the basic features of the kit are mounted on frame 12. The only major basic kit features not mounted on frame 12 are the reservior 170 and pump 172 of the liquid toner system illustrated in FIG. 7. The kit 10 is sold as a unit and may be placed directly into the corresponding prior art photocopying machine and installed in a few hours. In this manner the prior art machine may be rapidly converted with a minimum of wasted time in the manner to be described later.

Figure 4:
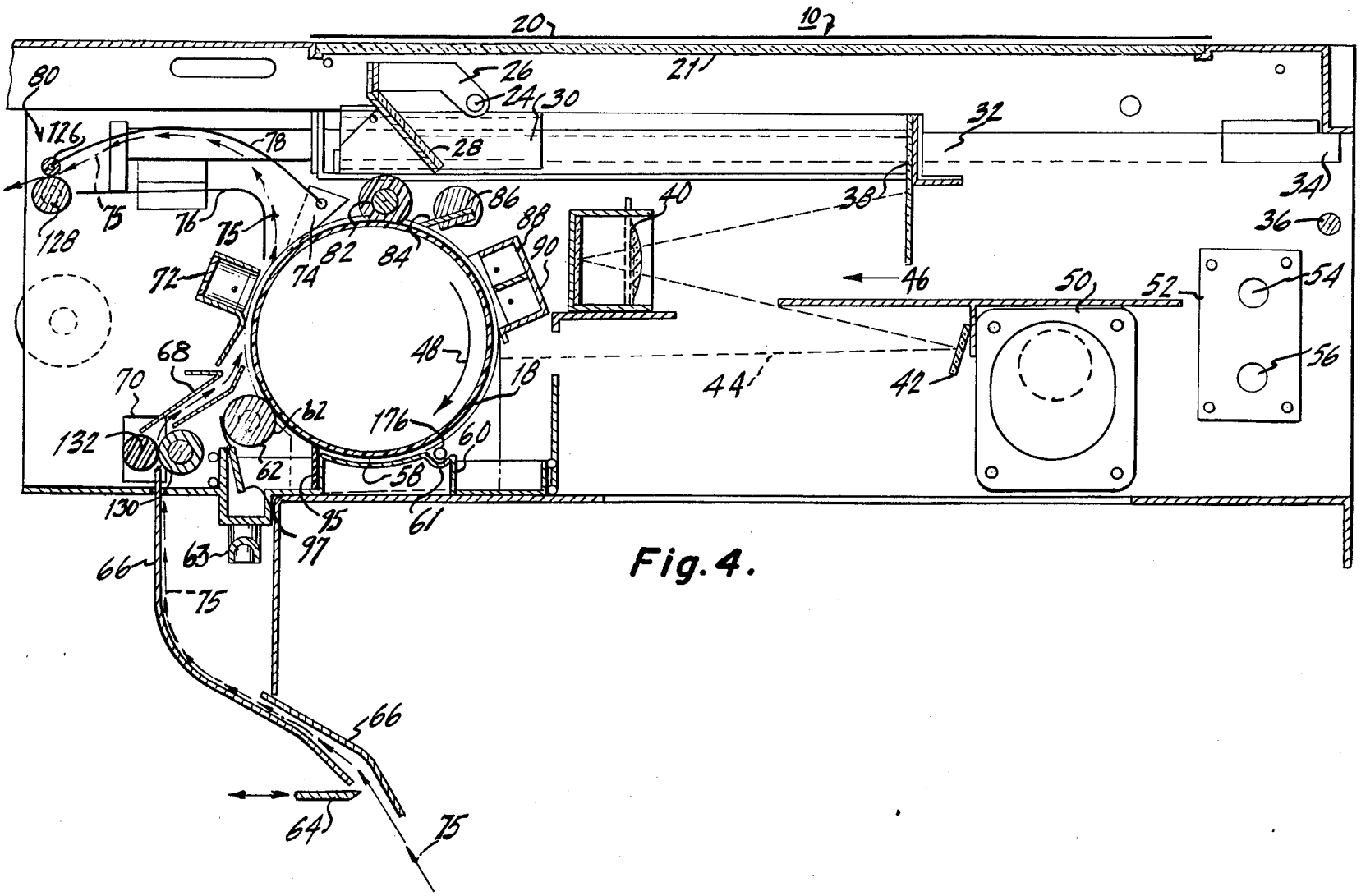
FIG. 4 is a partial cross-section view of the conversion kit as mounted on a prior art photocopying machine.

The details of the conversion kit 10 will be more fully understood when referring to cross-sectional assembly view 4 and related views 5 and 6. As seen in FIG. 4, a rotatable selenium drum 18 is mounted horizontally across the kit frame 12. When seen from the perspective of FIG. 4 the drum is adapted to rotate in a clockwise direction 48. The selenium drum is adapted to receive the procjection of the image of the object to be copied. The object 20, typically, a piece of paper, lies on top of a conventional glass plate 21 which formed part of the prior art machine. A bright light 24 is used to illuminate the object 20 in a manner known to those of ordinary skill in the art. An image projection system 22, which is integral with the kit 10, is adapted to scan the object 20 in synchronism with the drum 18 in order to place a charged image on it. The image projection system 22 includes the exposure lamp 24 and lamp reflector 26. Associated with the exposure lamp 24 in the first scanner reflector mirror 28. Lamp 24 and scanner mirror 28 are adapted to ride on sleeves 30 which are carried by scanner shaft 32. Scanner shaft 32 is in turn supported by scanner shaft brackets 34 at opposite ends thereof. A support brace 36 adds further support to the kit elements. Spring element 45 serves to dampen the force of the scanner unit on the scanner shaft 32 at no end of the scanner unit travel.

The light reflected from the object 20 first impinges upon the first scanner reflector mirror 28, then upon the second scanner mirror 38, then through lens and third mirror combination 40, then to fourth mirror 42 and finally onto drum18. The path of the image is illustrated as phantom line 44. First and second scanning mirrors 28 and 38 respectively are adapted to move in synchronism with selenium drum 18. Second scanning mirror 38 moves at one-half the speed of first scanning mirror 28. Lens 40 and fourth mirror 42 are stationary. Mirror 42 is mounted at 6° with respect to machine vertical. Accordingly, lens unit 40 and the fourth mirror 42 are stationary with respect to the frame 12 of the conversion kit during the scanning operation. The optical system is collectively referred to by an arrow as elements 46.

Prior to operation, the selenium drum is charged to a uniform high positive voltage typically in the neighborhood of 1,000 volts. As the drum 18 rotates in synchronism with the image projection system 46, an image is placed upon the drum whose charge density varies in direct proportion to the object being scanned. The drum 18 is adapted to be driven in a clockwise direction as illustrated by arrow 48. The mechanical power for the drum and the associated kit elements is provided by main drive motor 50. Associated with drive motor 50 is a clutch unit 52 including a forward clutch control 54 and a reversing clutch control 56. The clutch unit is mounted on a rigid bearing block.

Under the influence of drive motor 50, the image bearing selenium drum 18 first comes in contact with the liquid toner in metal trough 58 which is contained in plastic toner tray 60. The toner comprises a solution of negatively charged particles suspended in a dispersant. Positively charged image areas on the selenium drum attract the negatively charged toner particles thereby making the light image visible.

Figure 8B:
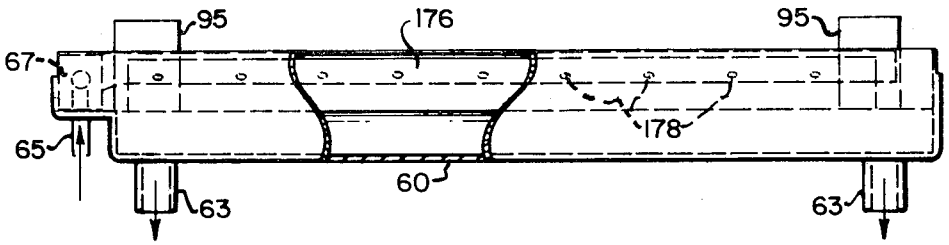
FIG. 8B is a side elevation view of the liquid toner tray of FIG. 8A.
Figure 8C:
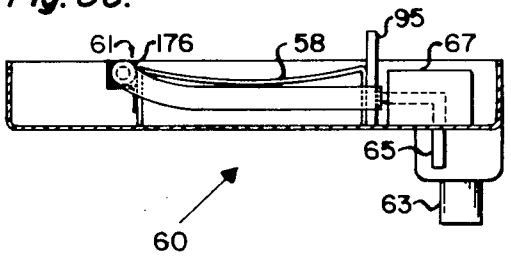
FIG. 8C is a cross-sectional view of the liquid toner tray of FIG. 8A.
Figure 8A:
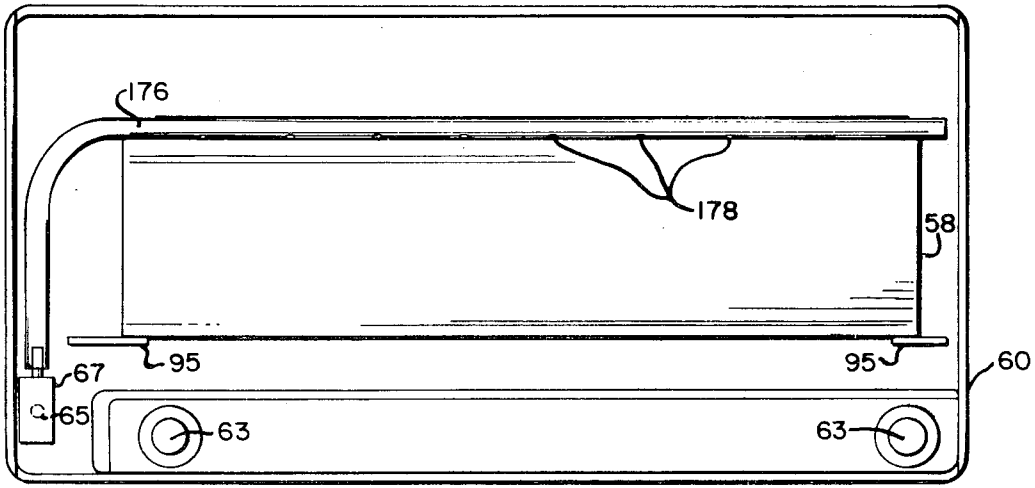
FIG. 8A is a top view of the liquid toner tray.

The plastic toner tray 60 is illustrated in detail in FIGS. 8A, 8B and 8C. A perforated liquid toner delivery tube 176 is adapted to fit in tube receiving groove 61. Toner tube 176 is fed by input line 174 which passes through input port 65 in toner tray 60. Excess liquid toner will overflow the edges of metal trough 58 and out of discharge outlets 63 which are attached to toner return lines 180. Metal trough 58 is alternatively charged from +450 volts D.C. to −450 volts D.C. Toner delivery tray 60 is part of an improved recirculating liquid toner system which will be described in more detail with respect to FIG. 7.

The developed image on the drum then passes over reversing roller 62 which serves to limit the depth of the toner solution on the drum after development. Wiper blade 97 cleans the toner solution off of roller 62. Roller edge wipers 95 keep toner out of the bearings which support reversing roller 62. The use of reversing rollers in the context of liquid toner systems is known to those of ordinary skill in the art.

The prior art machine illustrated in FIGS. 1 and 2 comes equipped with a mechanism 64 for cutting the roll fed paper to various appropriate lengths corresponding to the length of the object paper 20. Knife edge 64 is associated with the Model 520 prior art apparatus. The cut paper is directed upwardly through lower paper feed guide 66 to paper guide rollers 70 and from there through the upper paper feed guide 68 to contact with the selenium drum 18 opposite from transfer corona 72. Paper guide rollers 70 comprise an inner registration roller 130 and an outer registration roller 132. The paper path is illustrated by phantom line 75. The transfer corona 72 applies a high positive charge to the backside of copy paper thereby pulling the toner particles off of the drum surface and onto the paper itself. The paper is then picked off the drum 18 by a set of improved Teflon ® pick-off fingers 74. The separated paper is then directed through upper and lower wire paper exit guides 76 and 78 and through paper exit rollers 80 for deposit at the copy collection station. The exit rollers 80 comprise a short upper roller 126 and a larger lower roller 128. The separated paper may be fed over a heater unit which aids in evaporating any of the dispersant remaining on the copy paper.

As the drum 18 continues to turn in clockwise direction 48 it comes in contact with cleaning rollers 82 and cleaning blade 84. Cleaning blade 84 is held in position by assembly 86. The cleaning mechanism of the present invention comprises an improvement over the prior art and its features will be discussed in more detail below. The purpose of the cleaning roller 82 is to loosen the particles of toner still adhering to the drum so that the cleaning blade 84 can wipe them off. Lastly, the drum comes into the vicinity of corona discharge bracket 88 which serves to neutralize the selenium surface prior to its being charged to a uniformly high positive potential by charge corona 90.

Figure 5:
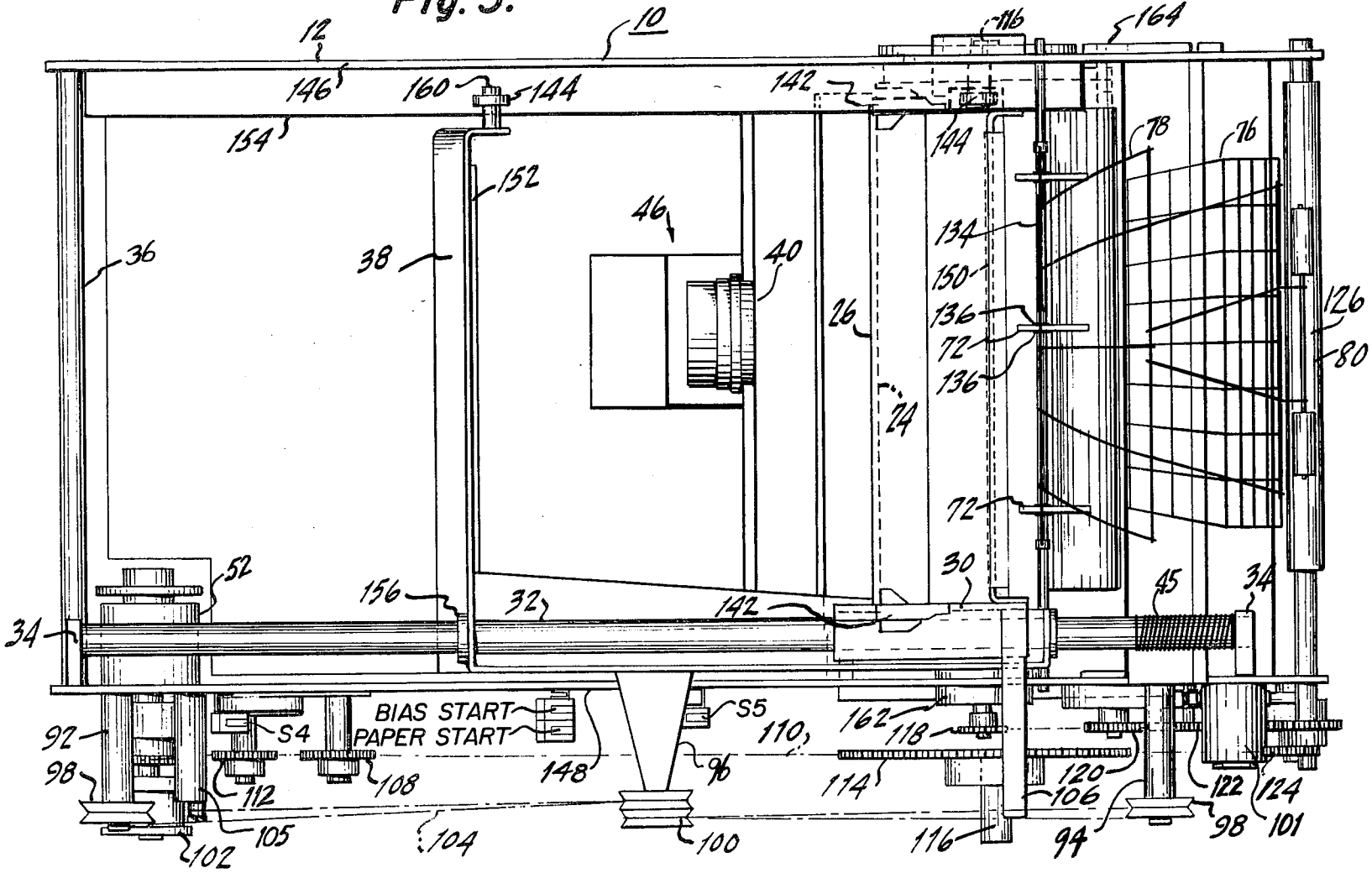
FIG. 5 is a top plan view of the conversion kit illustrated in FIG. 4.
Figure 6:
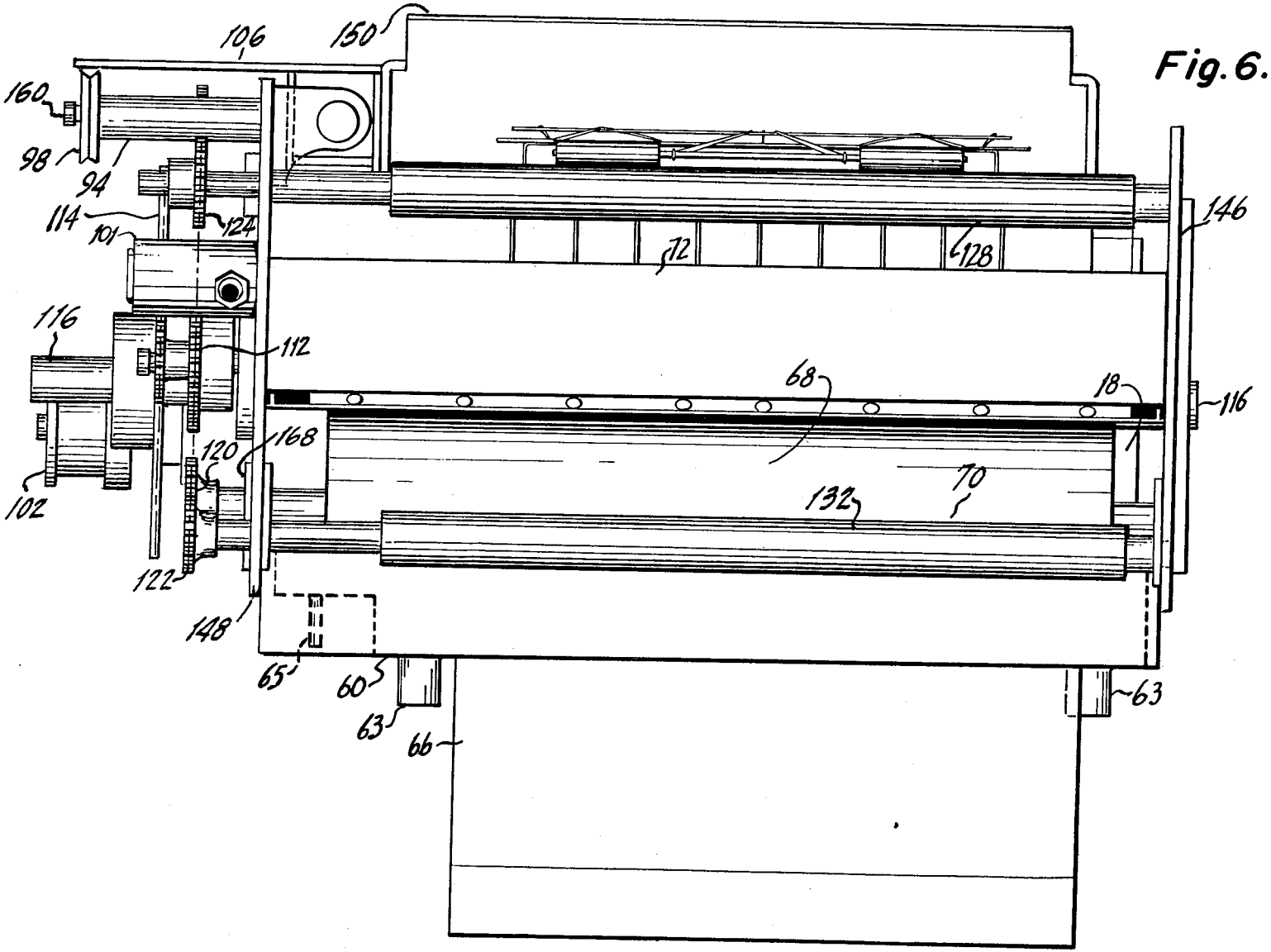
FIG. 6 is an end view of the conversion kit illustrated in FIG. 4.

Additional elements associated with the basic elements described with respect to FIG. 4 can be seen in FIGS. 5 and 6. Those associated elements are indicated sequentially as items 92 through 168 as follows:

| | |
|---|---|
| 92 | Fixed left pulley bracket |
| 94 | Fixed right pulley bracket |
| 95 | Roller Edge Cleaning Wiper |
| 96 | Pulley Bracket |
| 98 | Pulley |
| 100 | Double pulley |
| 101 | Dispersant Solenoid Valve |
| 102 | Scanner drive drum |
| 103 | Cleaning dispersant line to solenoid 101 |
| 104 | Scanner drive wire |
| 105 | Scanner Wire tie-off post |
| 106 | 1st Scanner pulley arm |
| 108 | Main drive motor sprocket (17 teeth) |
| 110 | Main drive chain |
| 111 | Spring loaded tension pulley |
| 112 | Idler sprocket |
| 114 | Drum sprocket |
| 116 | Drum shaft |
| 117 | Main drive chain idler |
| 118 | Cleaning roller sprocket (12 teeth) |
| 119 | Double sprocket |
| 120 | Reversing roller sprocket (14 teeth) |
| 121 | Tension Pulley mount |
| 122 | Registration roller sprocket (23 teeth) |
| 124 | Exit roller sprocket lower (28 teeth) |
| 126 | Exit roller upper |
| 128 | Exit roller lower |
| 130 | Registration roller inside |
| 132 | Registration roller outside |
| 134 | Pick off fingers shaft |
| 136 | Pick off fingers E - Rings |
| 142 | Lamp holders |
| 144 | Ball bearings |
| 146 | Front frame plate |
| 148 | Rear frame plate |
| 150 | 1st scanner assembly |
| 152 | 2nd scanner assembly |
| 154 | Scanner rail guide front |
| 156 | Scanner bearings |
| 158 | Clutch drive chain |
| 160 | Shoulder screw |
| 162 | Cleaning roller bearing block |
| 164 | Reversing roller bearing block |
| 166 | Idler pulley |
| 168 | Clutch Sprockets (18 teeth) |
| S4 | Microswitch |
| S5 | Microswitch |
| Bias Start | Microswitch |
| Paper Start | Microswitch |

The use of a plain paper roll feed in the context of a liquid toner photocopying system is believed to be new in the art. As previously discussed, a plain paper roll fed, liquid toner photocopying machine would be desirable for the high volume coin operated trade because of the low maintenance and high reliability of liquid toner systems and the low cost aspects of paper roll stock. There are, however, other aspects of the invention which differ significantly from prior art approaches.

For example, the sequence and arrangements of the liquid toner system employed in conversion kit 10 is 180° reversed from prior art liquid toner systems. Such a reversal is necessary to accomodate the existing systems such as found on the prior art equipment illustrated in FIGS. 1 and 2.

Prior art liquid toner systems typically employ a paper pick-off mechanism which includes a paper pick-off blade at the edge of the drum and a pressure wire associated therewith. The paper pick-off blade mechanism has been found to be relatively unreliable and accordingly, a mechanism was developed to more reliably remove paper from the drum 18. The new mechanism comprises a plurality of paper pick-off fingers 72 which may be seen in FIGS. 4 and 5. The pick-off fingers 72 have a triangal-like shape and would preferably comprise a Teflon® or a Nylon® wedge or may comprise a fiber-filled Teflon® or Nylon® wedge. Teflon® and Nylon® are trademarks of the E. I. duPont de Nemours Corporation of Wilmington, DE. FIG. 5 illustrates the manner in which three pick-off fingers 72 are mounted between pairs of E. Rings 136 on a common shaft 134. The use of paper pick-off fingers in the context of liquid toner systems is believed to be new even though it is possible that other types of pick-off fingers may have been employed in certain prior art dry toner systems such as those produced by the Xerox Corporation of Rochester, New York.

The lamp 24 employs in conversion kit 10 is preferably a high density 950 watt 120 volt bulb. It has been found that in the context of a converted paper roll fed machine, the higher intensity bulb produces a better copy. It is believed that prior art liquid toner equipment employs lower intensity bulbs in the range of 400 watts at 80 volts.

An important difference between the present system and prior art liquid toner systems is in the method and apparatus of delivering liquid toner to the toner tray 60. In a typical prior art liquid toner machine the liquid toner is pumped in one direction up to a trough where it comes into contact with the surface of the drum. In between scanning operations the liquid toner tends to sit idle. Therefore it has been the practice in the trade to clean the drum and toner system once every 10,000 copies. While such maintenance requirements may not be a burden for those with light copying demands, it is not acceptable for use with high volume coin operated equipment such as may be used in a public library. Accordingly, a recirculating liquid toner system was developed which did not necessitate the high degree of maintenance associated with prior art equipment. The system of the present invention is illustrated schematically in FIG. 7. The system includes a 2-½ gallon liquid toner reservoir 170 which is connected via pump 172 and input line 174 to a piece of perforated tubing 176 including a plurality of discharge holes 178 therein. Perforated tubing 176 is adapted to be received in slot 61. Discharge holes 178 are aligned along the length of toner tray 60 so that the toner is evenly dispensed into metalic trough 58. Perforated tubing 176 preferably comprises a hollow plastic, plexiglass-like rod or a polyethyelene tube about 14" long and ¼" to ½" in outside diameter. The discharge holes 178 are about 1/32" in diameter and spaced evenly along the length of the tubing 176 at intervals of ½ to 1½ inches. The tray 60 includes an inlet port 65 through which toner input line 174 connectes to the pump 172 and reservoir 170 to one end of tubing 176. Both ends of the toner tray are connected to discharge lines 180 which return the overflow toner to the reservoir 170 via discharge outlets 63. Each time the machine is used the toner is pumped from the reservoir 170 to the toner tray 60 where it is picked up by the drum. Any excess is recirculated through discharge ports via overflow lines 180 back to the reservoir 170. In this sense the liquid toner system is a recirculating system. In the preferred embodiment the toner system only circulates during the scanning operation and would not circulate when the machine is not in use. As a practical matter, commercial coin operated photocopying machines are used so heavily that continual recirculation is desirable.

The drum cleaning system of the present invention comprises a stationary squeegee or cleaning blade 84 and a driven cleaning roller 84. Also incorporated into the invention is a solenoid valve system 101 which dispenses toner through a perforated tube onto the drum before the cleaning blade 84 and cleaning roller 82 in response to a signal from relay K9. Line 103 supplies dispersant cleaning fluid to solenoid 101. See FIG. 12A. It has been found that the cleaning system of the present invention is superior to prior art approaches from a maintenance and mechanical point of view.

A prior art drum drive system typically includes a spindle shaft upon which the drum is mounted. According to the present invention two drum end caps may be used for the purpose of mounting the drum instead. A shaft 116 passes through the drum caps and serves as a mounting means for the drum drive sprocket 114. In this manner the drum is driven by the end caps which in turn are directly driven by the drum chain. In prior art liquid toner equipment it is believed to be common practice to drive the drum through the intermediary of a pinion gear or the like.

The Model 520 photocopy machine illustrated in FIGS. 1, 2, 10A and 10B has to be mechanically and electrically modified in order to accept conversion kit 10.

Referring to FIG. 2, the following mechanical elements are removed in their entirety in order to prepare for conversion:

| Item | Description | Figure |
|---|---|---|
| 202 | Air Blower (Relocated) | 11A |
| 207 | Conveyor | 11B |
| 217 | Power Supply | 11E |
| 218 | Processor and Toner Tray | 11F |
| 219 | Reflector and Lamp Assembly | 11G |
| 225 | Turn around guide | 11I |

The following items are removed in part and retained in part:

| Item | Description | Figure |
|---|---|---|
| 211 | Flap and solenoid assembly | 11C |
| 214 | Optics | 11D |
| 224 | Corona bracket and motor | 11H |

More specifically the following portions are removed or retained from items 211, 214 and 224:

FLAP AND SOLENOID ASSEMBLY 211

Figure 11B:
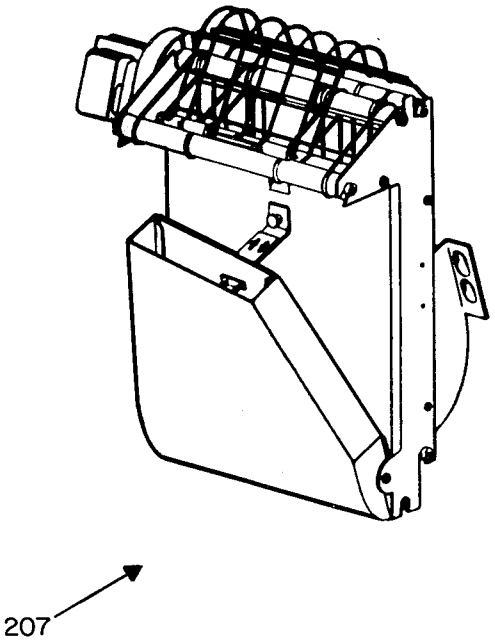
FIG. 11B is a perspective view of the conveyor element 207 which is removed from the prior art machine illustrated in FIGS. 1 and 2.
Figure 11A:
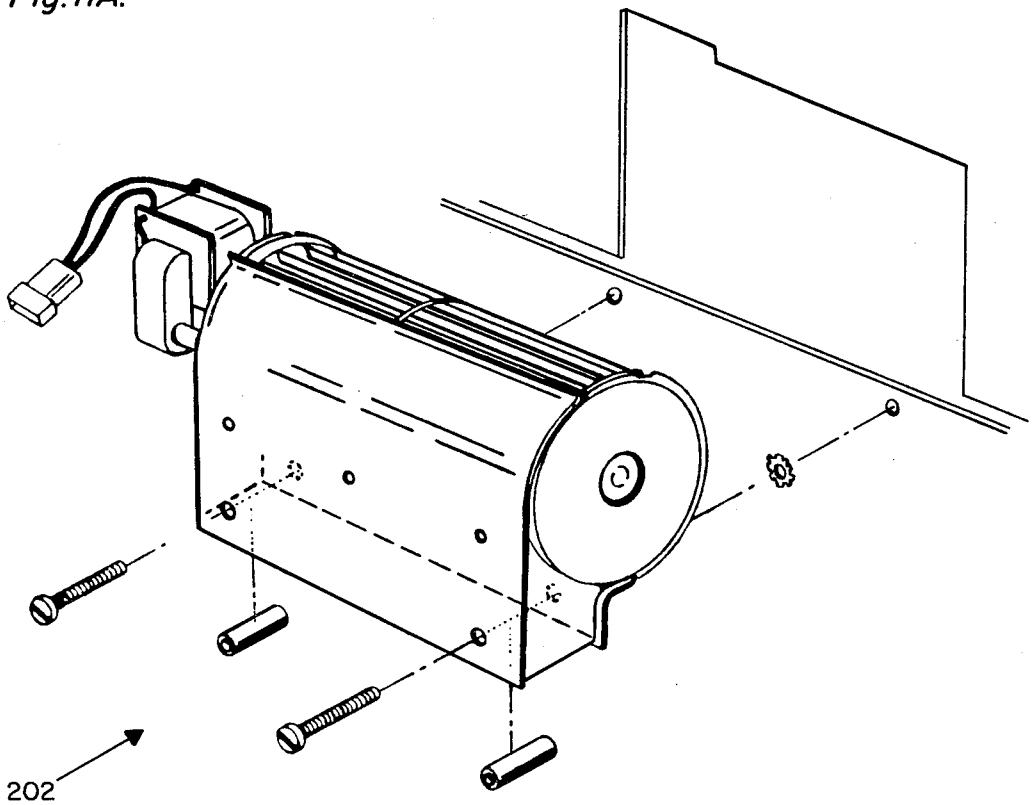
FIG. 11A is an exploded perspective view of the air blower element 202 which is removed from the prior art machine illustrated in FIGS. 1 and 2.
Figure 11C:
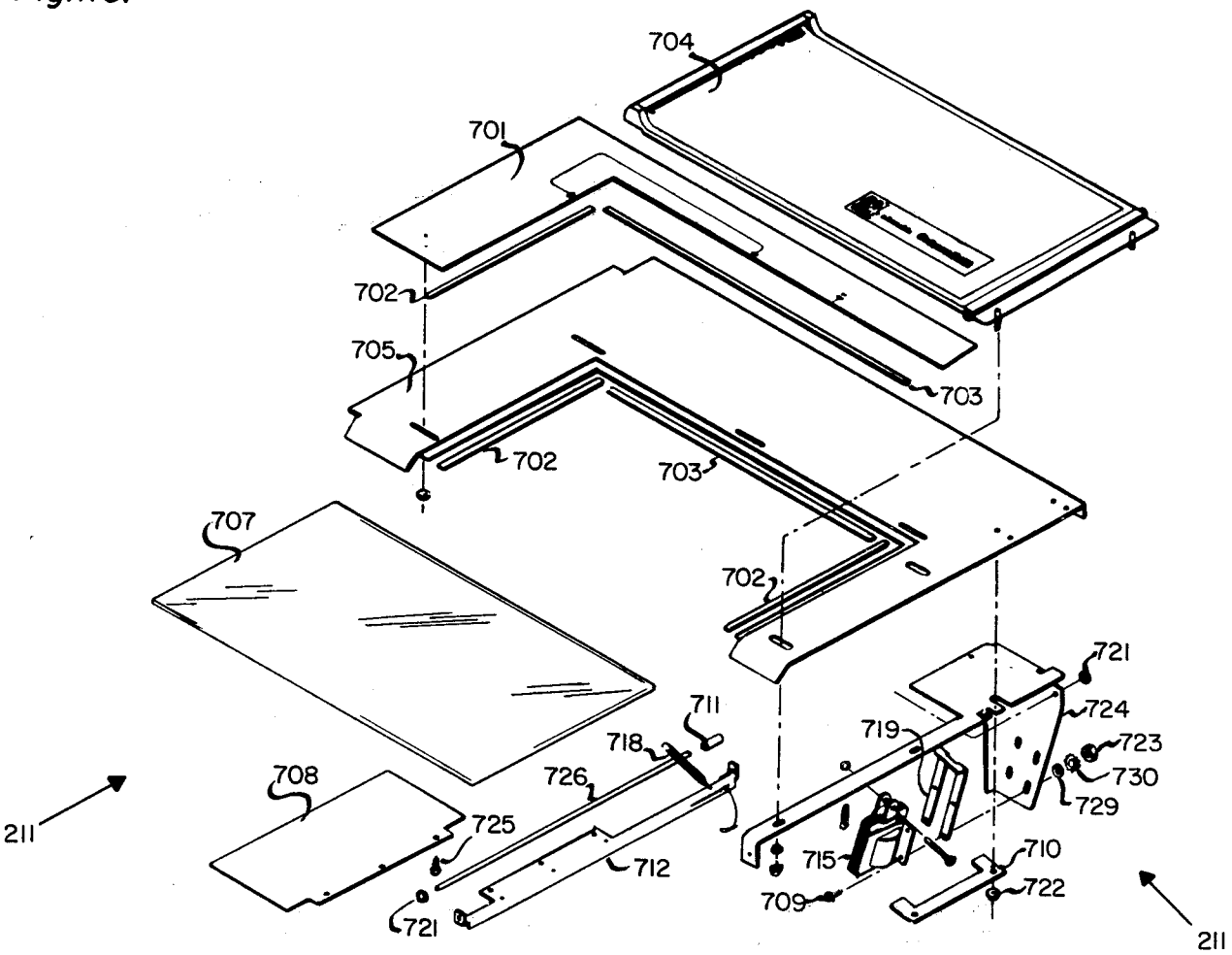
FIG. 11C is an exploded perspective view of the top flap and solenoid assembly 211 which is partially removed from the prior art machine illustrated in FIGS. 1 and 2.
Figure 11D:
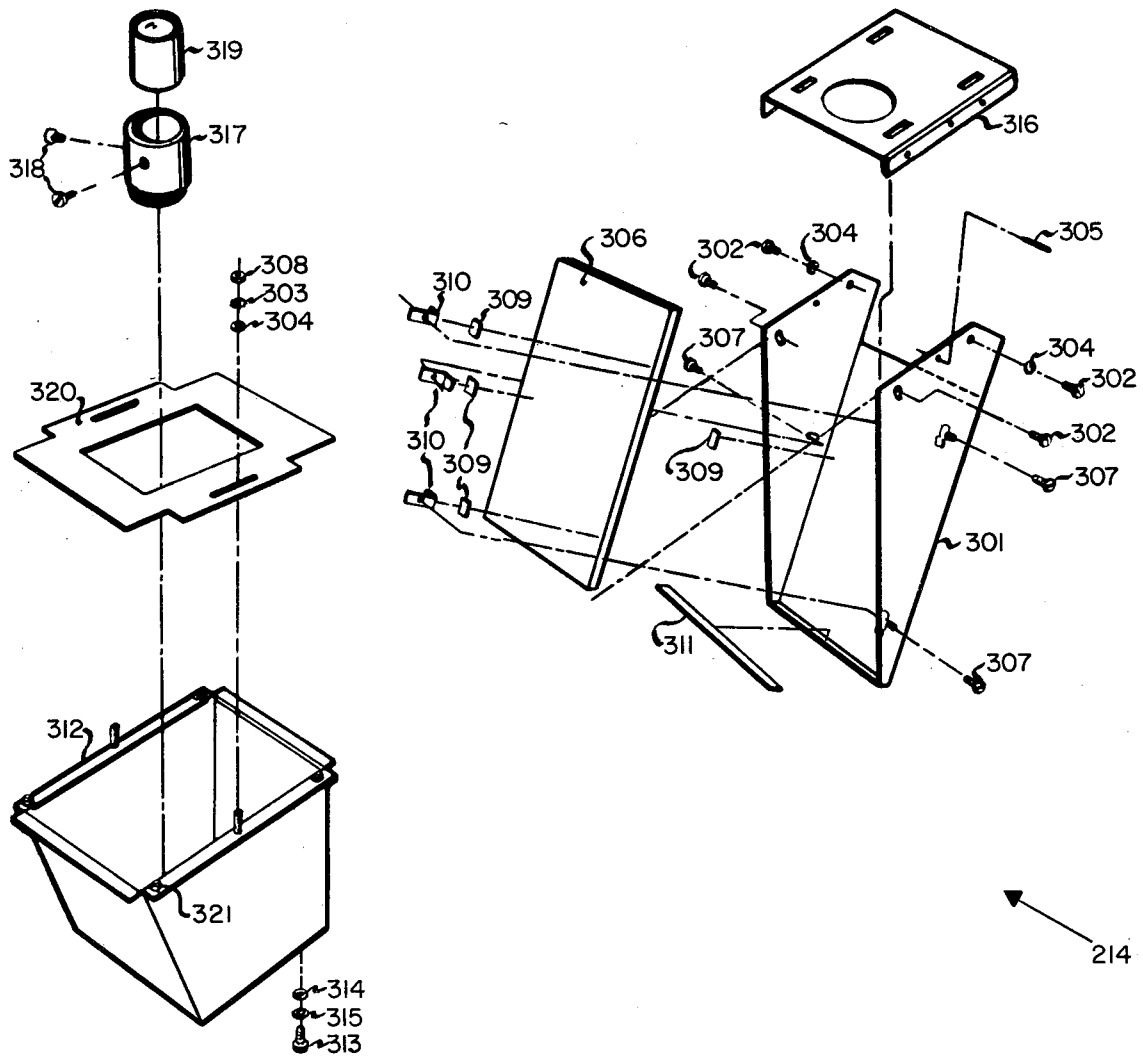
FIG. 11D is an exploded perspective view of the optical system 214 which is partially removed from the prior art machine illustrated in FIGS. 1 and 2.
Figure 11F:
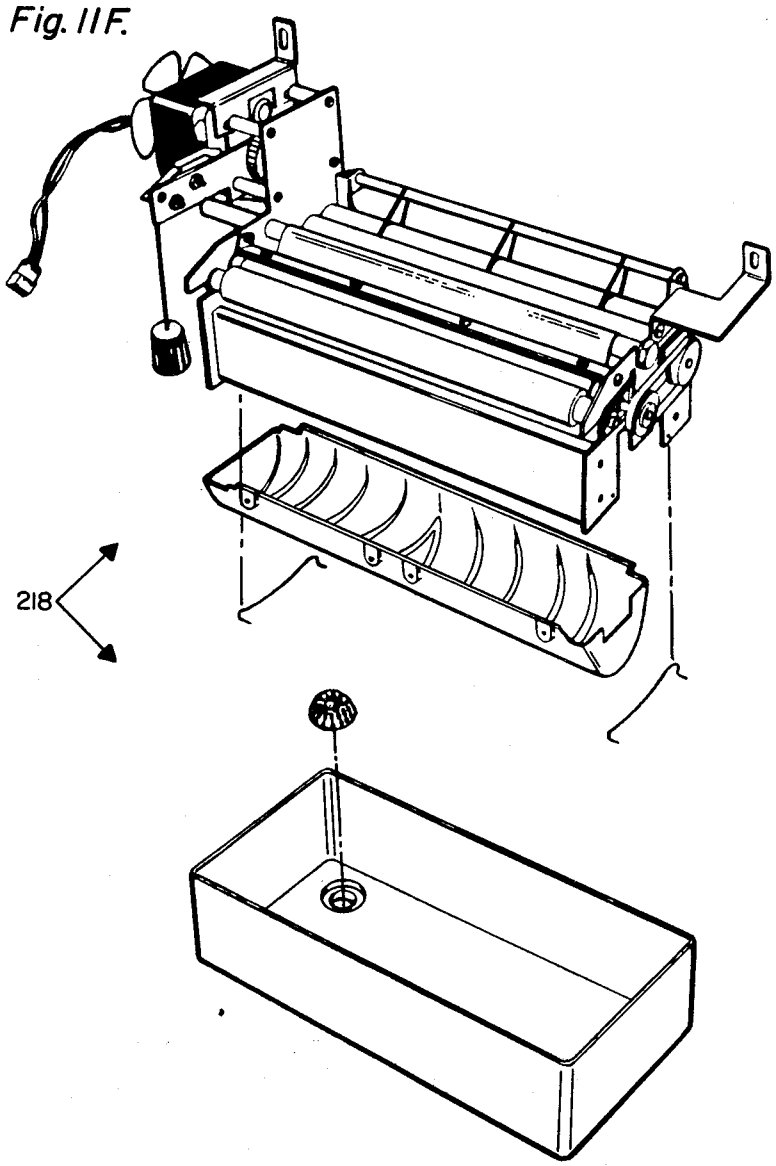
FIG. 11F is an exploded perspective view of the processor and toner tray assembly 218 which is removed in its entirety from the prior art machine illustrated in FIGS. 1 and 2.
Figure 11E:
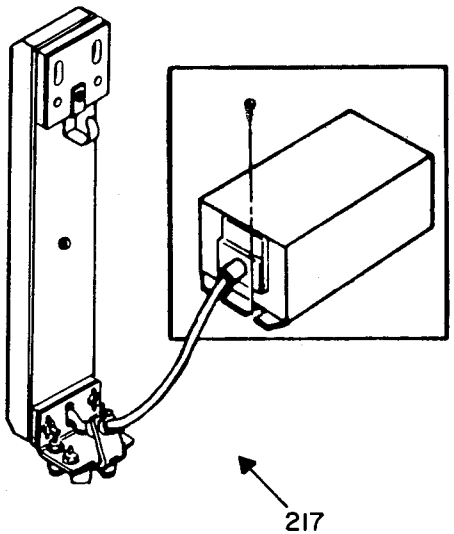
FIG. 11E is a perspective view of the power supply and charge bracket assembly 217 which is removed from the prior art machine illustrated in FIG. 1 and 2.
Figure 11G:
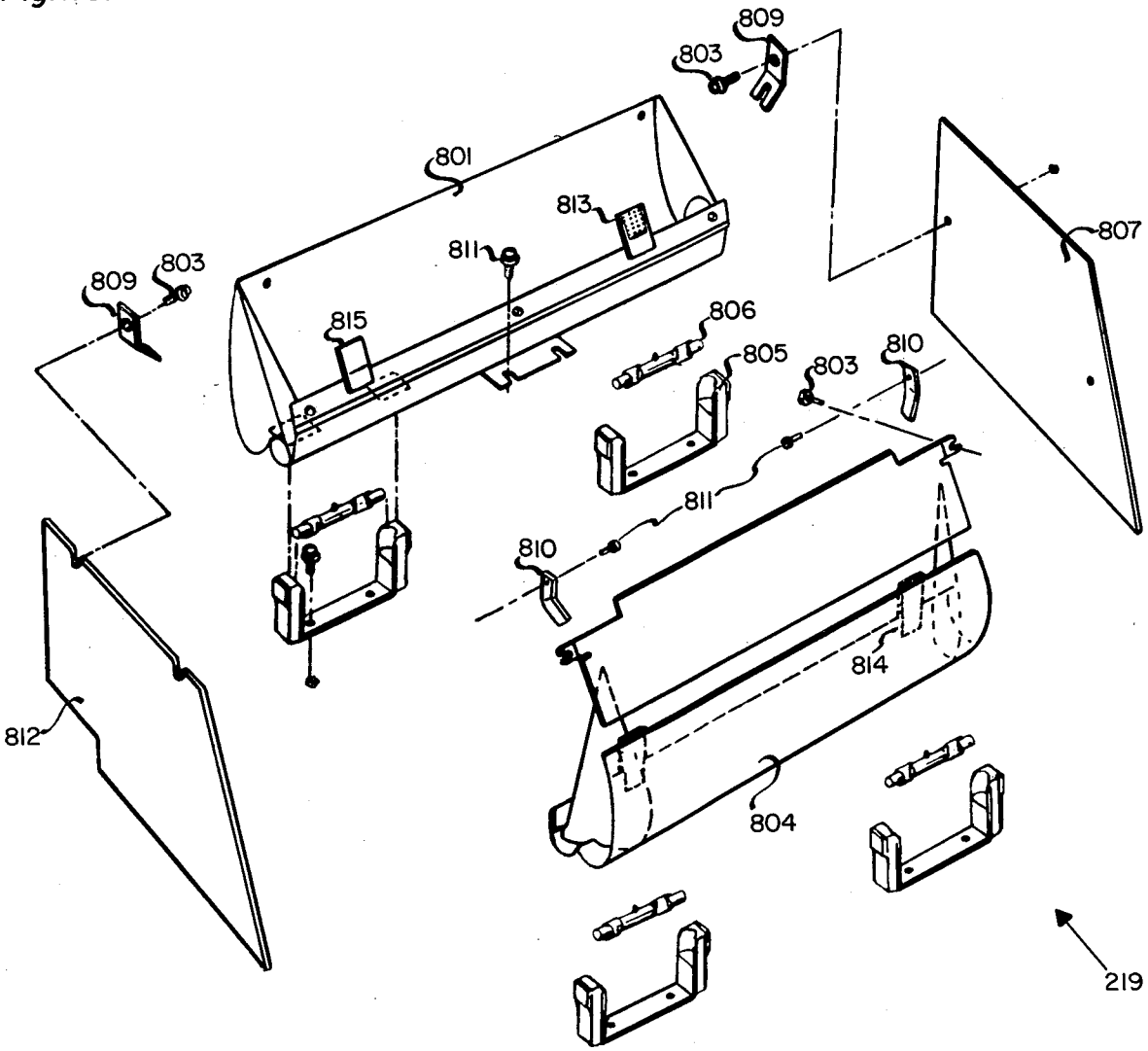
FIG. 11G is an exploded perspective view of the reflector and lamp assembly 219 which is removed in its entirety from the prior art machine illustrated in FIGS. 1 and 2.
Figure 11I:
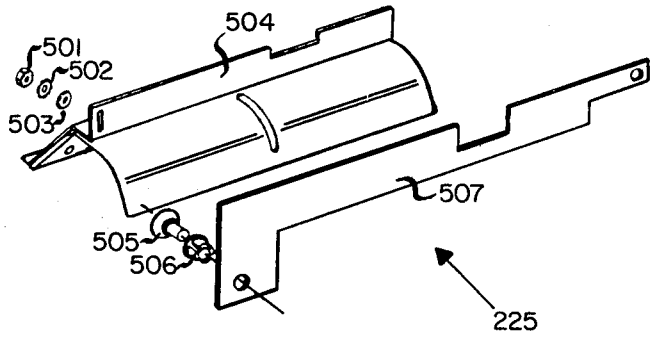
FIG. 11I is an exploded perspective view of the paper turn around assembly 225 which is removed in its entirety from the prior art machine illustrated in FIGS. 1 and 2.
Figure 11H:
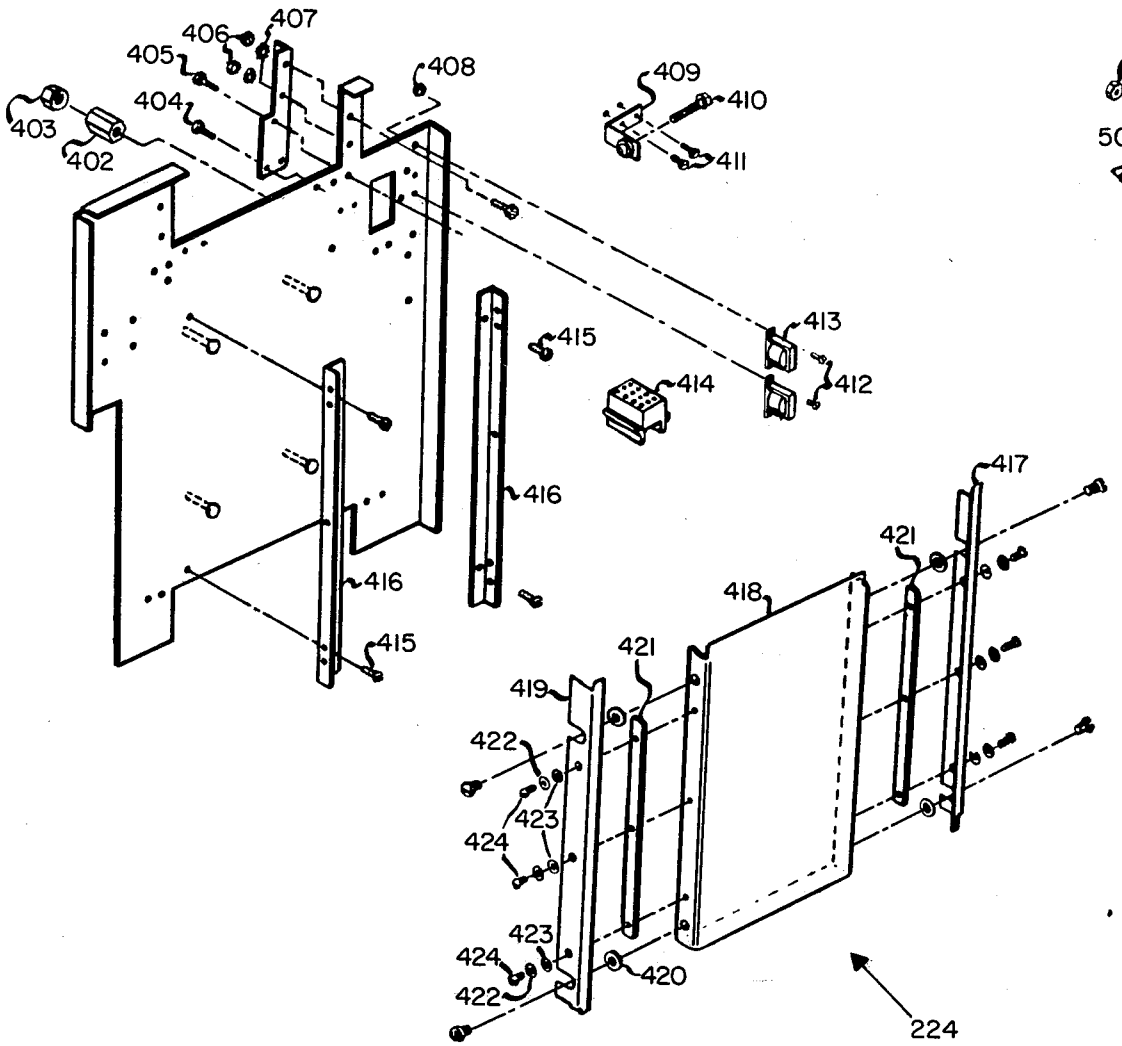
FIG. 11H is a partial exploded perspective view of the corona bracket and transport motor assembly 224 which is partially removed from the prior art machine illustrated in FIGS. 1 and 2.
Figure 11J:
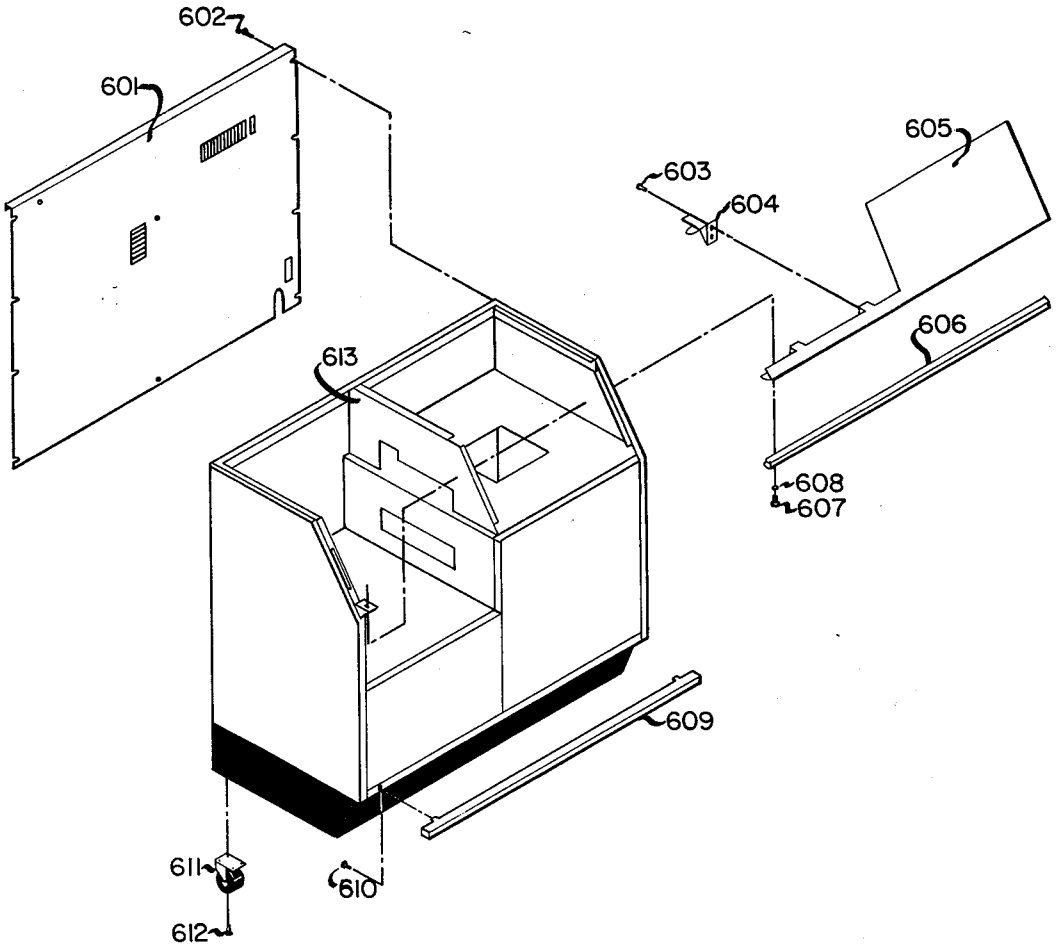
FIG. 11J is an exploded perspective view of the prior art chassis showing the removal of center support element 613.
Figure 11L:
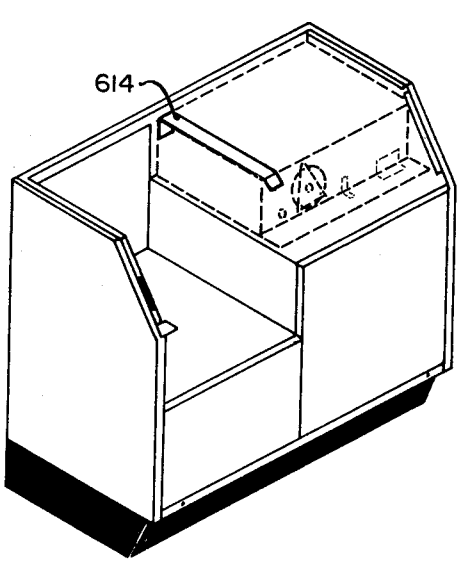
FIG. 11L is a perspective view illustrating the mounting of the center support brace element 614.

-continued (FIGURE 11C)

| Item Removed | Item Retained |
|---|---|
| 706 (studs must be cut flush to) | 701–705 |
| 708 | 707 |
| 712 | 709 |
| 715 | 710 |
| 716 thru 730 | 711 |
| | 713 |
| | 714 |

OPTIC ASSEMBLY 214

(FIGURE 11D)

| Item Removed | Item Retained |
|---|---|
| 301–311 | 312–315 |
| 317–319 | 320 |
| | 321 |

TRANSPORT 224

(FIGURE 11H)

| Item Removed | Item Retained |
|---|---|
| 409–411 | 401–408 |
| | 412–424 |

CABINET CHASSIS ASSEMBLY (FIGURE 11J)

| Item Removed | Item Retained |
|---|---|
| 613 (center support) | 601–612 |

After the foregoing has been either completely or partially removed as described above, the following major elements are understood to be *retained* from the prior art Model 520 machine illustrated in FIGS. 1, 2, 10A and 10B:

MAJOR ELEMENT RETAINED (FIGURES 1 and 2)

| Item | Description |
|---|---|
| 201 | Access Door Assembly |
| 203 | Cabinet Assembly |
| 204 | Coin Box Assembly |
| 205 | Panel |
| 206 | Control Switches |
| 208 | Copy Counter |
| 209 | Exit tray |
| 210 | Exposure time |
| 212 | Illuminated Sign Assembly |
| 213 | Master Switch and Fuse |
| 215 | Original Copy Area |
| 216 | Paper Spindle |
| 220 | Refresher Assembly |
| 221 | Relay Chassis |
| 222 | Toner Pump and Tubing |
| 223 | Toner scale |
| 226 | Coin Return Cup |
| 227 | Heater and Humidistat |
| 228 | Left Pedal Pedestal Assembly |

Figure 11K:
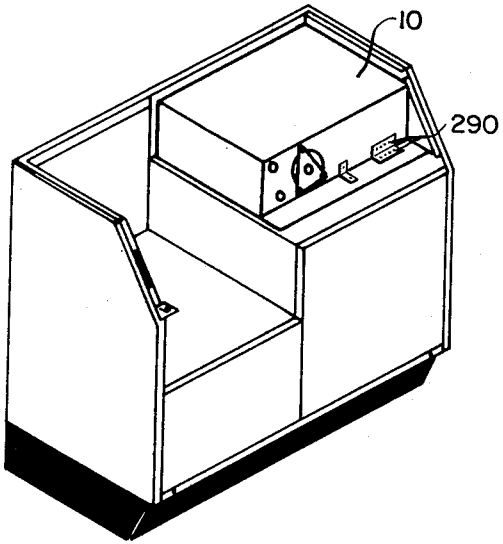
FIG. 11K is a perspective view of the prior art chassis showing the initial alignment and attachment of the conversion kit 10 to the prior art chassis illustrated in FIGS. 1 and 2.

The first step in converting the machine is to remove in whole or in part items 202 (and relocated), 207, 211, 214, 217, 218, 219, 224 and 225 as described above, leaving prior art items 201, 203, 204, 205, 206, 208, 209, 210, 212, 213, 215, 216, 220, 221, 222, 223, 226, 227 and 228 intact and in place. Next the field service man removes the conversion kit 10 from its packing box and places it on the copier chassis where the original reflector and lens assembly 219 was previously housed. The holes 290 on the front and rear panel support of the new kit 10 are lined up with those of the old lamp assembly 219. The old screws are then used to fasten the new bond kit 10 to the frame, i.e., chassis, of the prior art copier in the manner illustrated in detail in FIG. 11K.

The toner tray and new bond kit should hang over the center of the frame support of the copier chassis. Next the old processor inlet toner hose is connected to a small conventional "Y" connector furnished with the new bond kit 10. It may be necessary to shorten the old hose in order to accomodate this connection. The old processor drain hose is then connected to a large "Y" connector also furnished with the new bond kit and in a similar fashion it may be necessary to shorten the old drain hose to accomodate this connection.

Figure 12A:
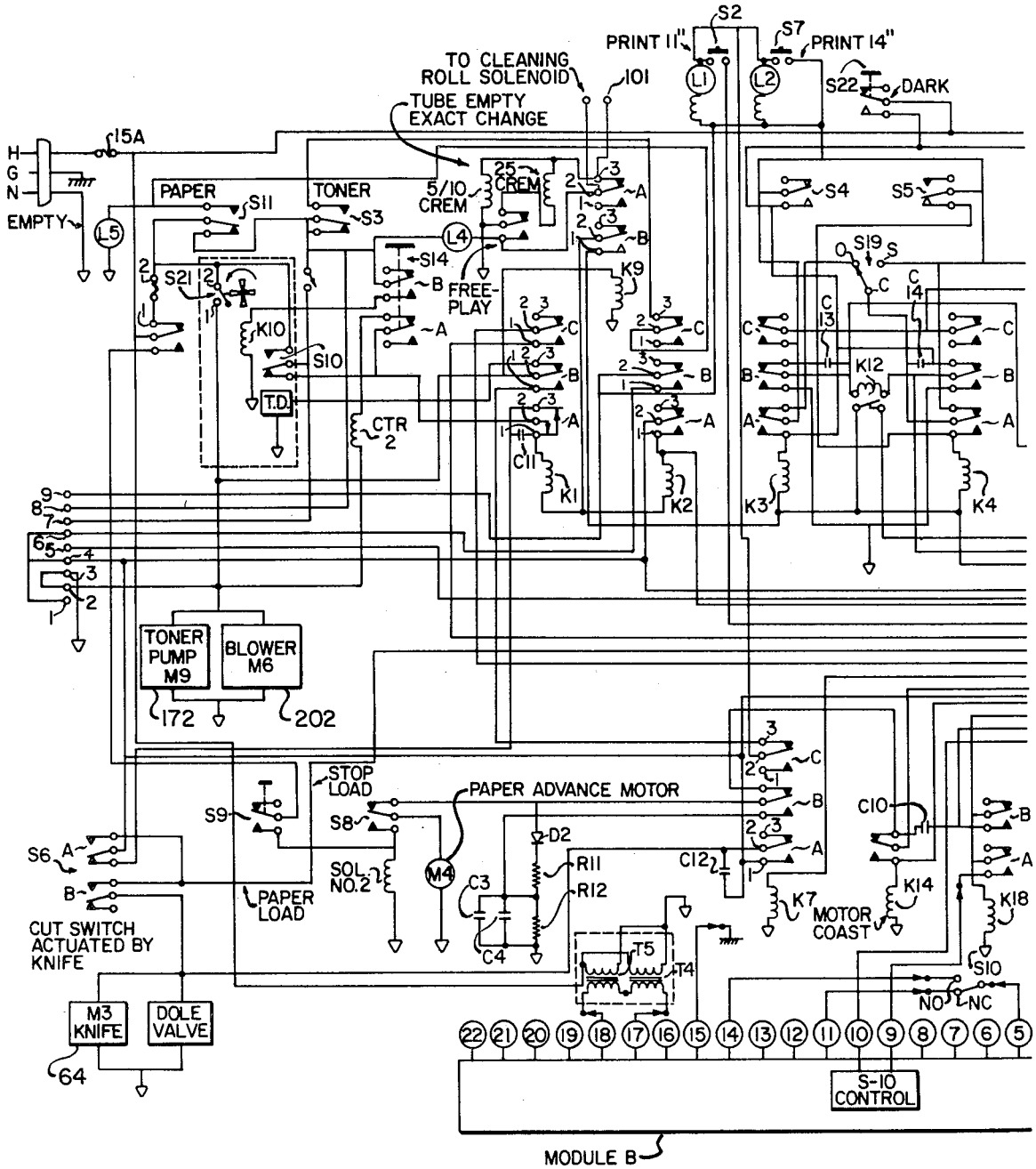
FIGS. 12A and 12B are the electrical schematics of the converted photocopy machine.
Figure 12B:
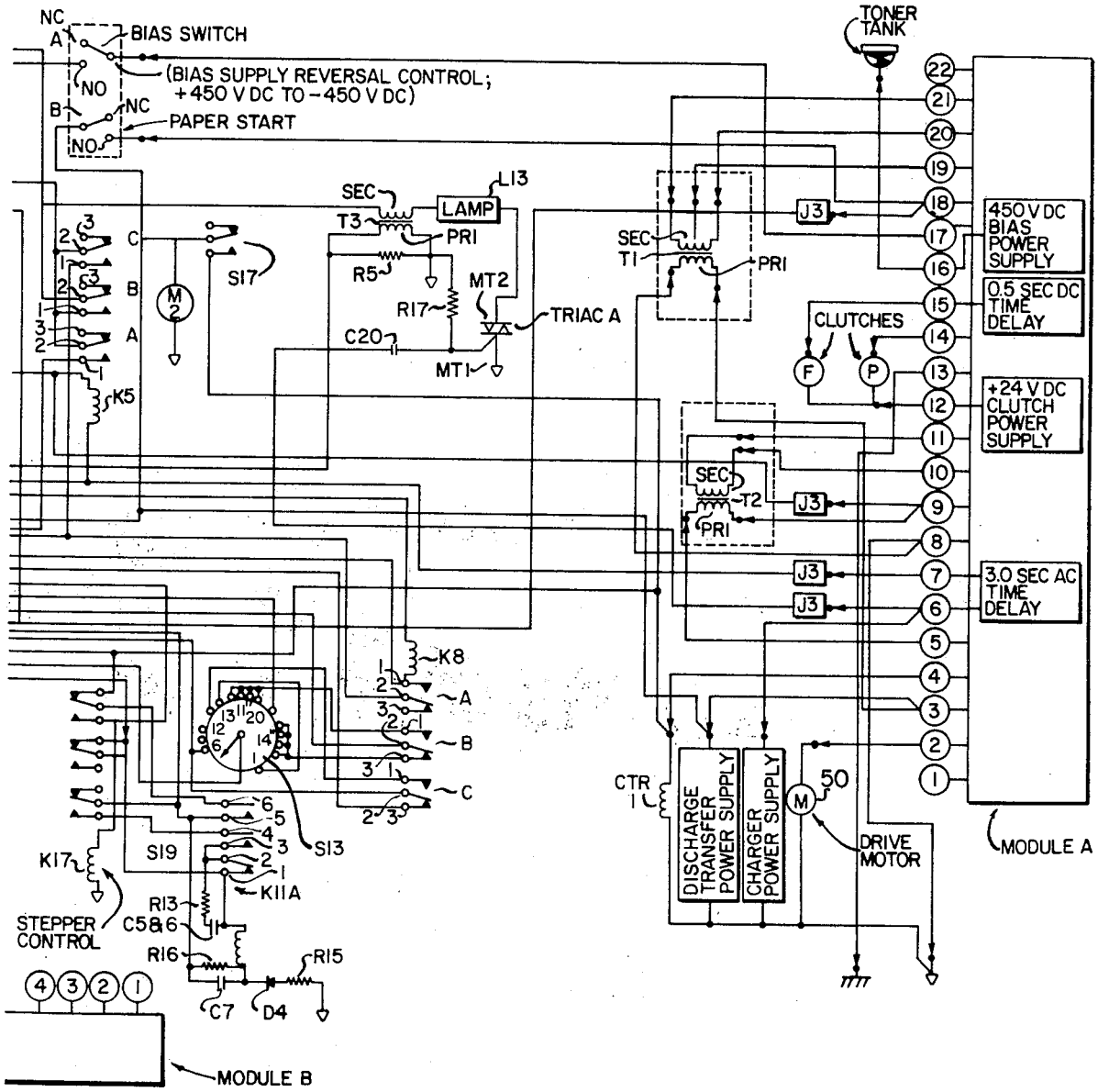

After the air blower 202, as seen in detail in FIG. 11A, is removed from the copier, it is remounted (i.e. relocated) at the location where the old mirror housing was situated and directed upwardly. The old screws from the former mirror housing assembly can be used to attach the blower motor at the new location. Electrical connections with the circuit illustrated in FIGS. 12A and 12B are then made to the wires indicated.

A Molex plug and 4 inches of wire are removed from the processor and the ends of the wire are connected together in a Molex plug with a wire nut. The rewired Molex plug is then placed back in its original connection in the copier.

All wires from the top plate "L" Rule are removed. The two electrical leads from the lamp of the new bond kit 10 are inserted into a Jones plug and the plug is then placed in the original electrical connection location J4. The turn around guide is installed after loosening the screws on the stop load paper switch. The guide must be levelled and evened in order that the paper be discharged in a straight manner. The paper entrance guide is attached to the copier center frame where holes are already provided therefore by means of a screw and nut. The front hose of the toner tray is inside of the paper guide arm and the rear hose is located on the outside of the paper guide arm. The corona power supply unit rests on a shelf above the paper spindle.

Figure 10A:
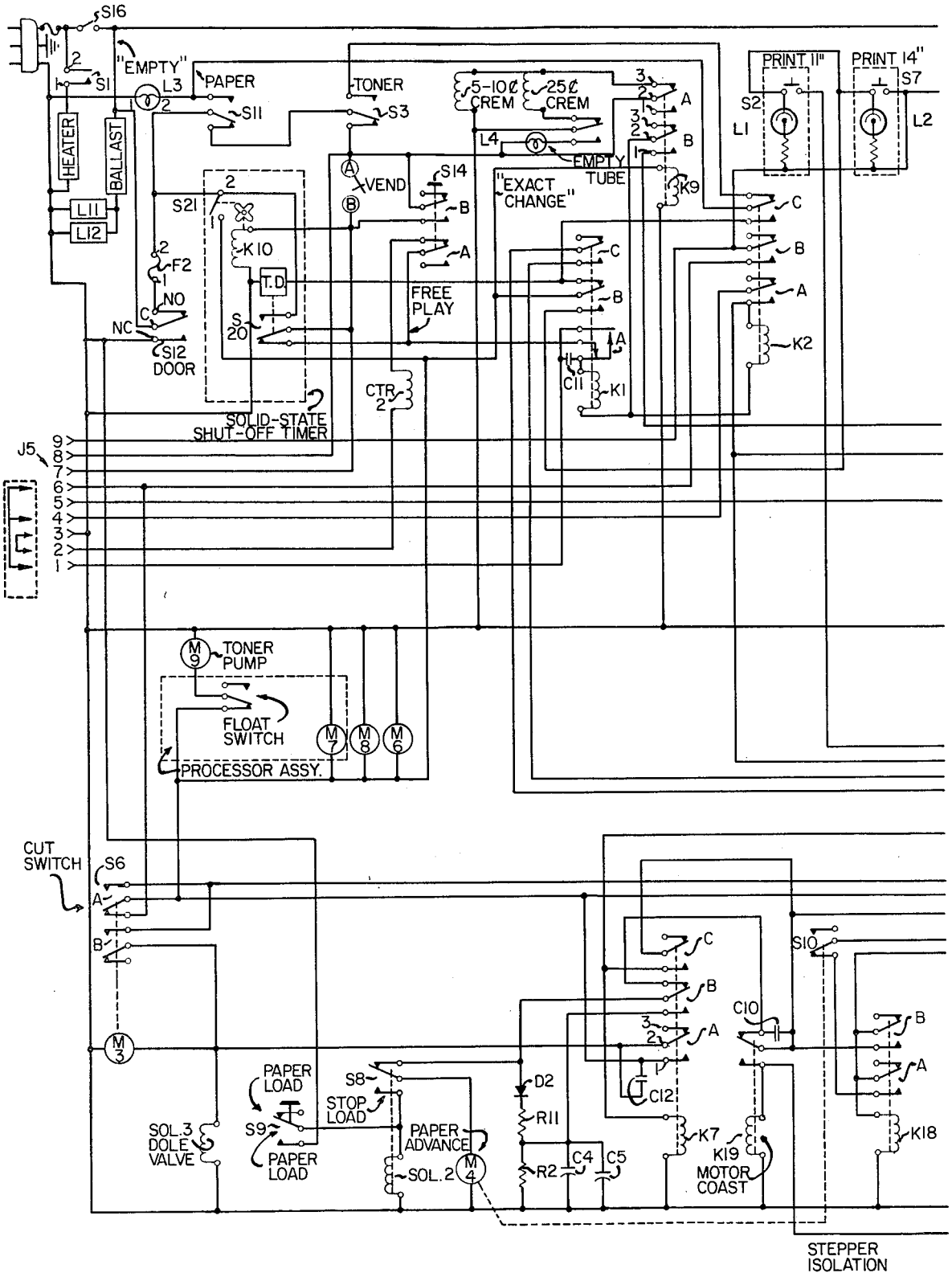
Fig. 10A. PRIOR ART
FIGS. 10A and 10B are the electrical schematic of the prior are Olivetti Coinfax Model 520 photocopying machine.
Figure 10B:
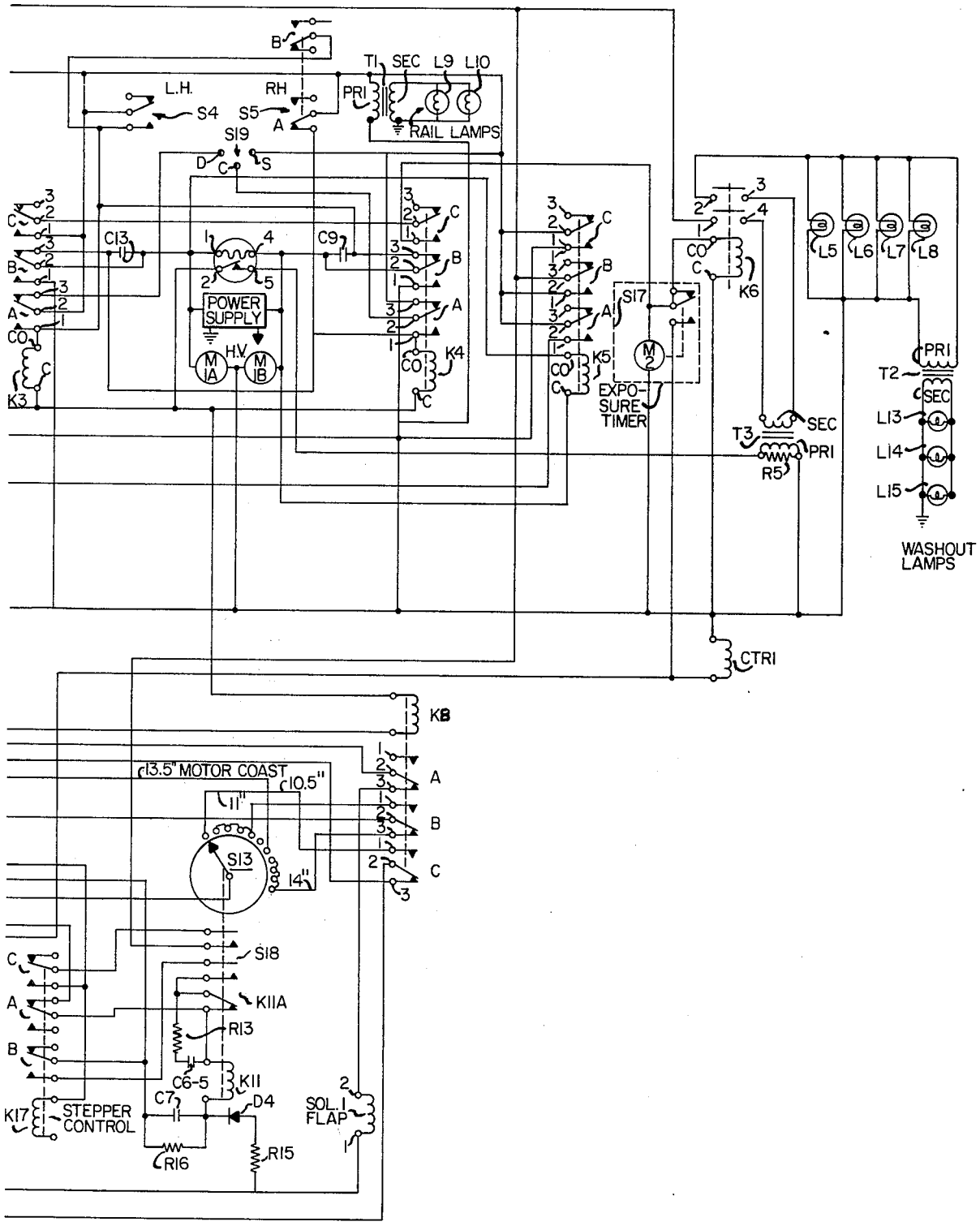
Fig. 10B. PRIOR ART

The prior art electrical circuit is illustrated in schematic detail in FIGS. 10A and 10B. In order to better understand the nature of the electrical conversion that takes place, an explanation of the prior art electronics could be helpful. However, the operation of the device illustrated in FIGS. 10A and 10B is well known to those of ordinary skill in the art, especially field mechanics who maintain the equipment.

Prior to disclosing the sequence of operation of the prior art electrical system illustrated in FIGS. 10A and 10B, the operation of the following individual elements should be understood.

The stop load solenoid SOL 2 is energized whenever the front panel doors are opened S12 in the normally closed position, and S9 is depressed. The solenoid releases the control arm of S8, which causes the advance motor to run.

The solenoid dole valve SOL 3 is energized whenever the machine is in the cut cycle. This solenoid operates a needle valve which allows refresher to flow into the toner circulation system. Copy counter 1 (208) is a five digit counter which is energized whenever the machine is in an advanced cycle. It records all copies made on the machine. Compartment heater Ht 1 (227) is a wire wound 100 watt heating element which reduces the moisture level within the machine whenever S1 is closed. The power supply has an output of 6800 volts negative DC which is applied to the Corona Wire in the charge bracket. The power supply is on any time that the charge motor is running. The jumper plug J5 is located outside of the sign assembly. It provides a ground connection for counter 2 (the vend counter) and conveys SHL power from S6 to K1A and K2A.

Prior to the copy cycle, there are certain pre-operative circuits which come into play. Those circuits include the humidistat circuit, the advertising sign circuit, the charger part circuit, the paper load circuit, the paper - toner empty circuit, the exact change circuit, the five - 10¢ CREM circuit, the vend switch and the preplay switch. The following is a discussion of the prior art pre-operative circuits such as found on the Olivetti Model 520 machine.

The Humidistat Circuit consists of the Humidistat Switch, S1 and the Heater Ht1. When the humidity or moisture in the cabinet rises above the setting of S1, the Switch reacts by closing its contacts. This causes Ht1 to heat up and dry out the moisture. This operation can take place any time the machine is plugged in.

The Master Switch, S16 controls all of the remaining circuits in the machine. If the Switch is turned off, or if there is an overload or short circuit and the Circuit Breaker trips, nothing beyond this point will operate.

The Advertising Sign Circuit consists of the Ballast and the two Sign Lamps L11 and L12. As the name implies, the lighted sign advertises the availability of the machine. The fact that the sign is lighted also tells the serviceman that house current is available, provided that S16 is not tripped.

The charger Park Circuit consists of the Charger Park Switch, S22, the Charge Relays, K3 and K4, the Charge Control Relay, K5, the Limit Switches, S4 and S5, and the Charger Motor, M1. The Park Switch is intended for use when the Charger Bracket is at the front of the machine, which would interfere with the loading of paper. This circuit bypasses the Door Interlock Switch S12 since the Right Hand Door must be opened to operate the switch.

The Charger Park Circuit works in the following manner. When the Charger Bracket is to the front and Switch S22 is depressed, the Charge Relay K3 energizes. Because the limit Switch S4 is passing current, (the Charger Bracket is holding the switch arm) power is also directed through this Switch to the B Section of Charge Relay K4. This relay is not energized; therefore, power is fed directly to the B stage of the Charger Motor M1. When K3 became energized, all of its contacts transferred. One result is that K3B2 has picked up a Cold Line, so there is now a complete electrical path to the Power Supply and the Charge Control RelayK5 to energize at the same time. The contacts of K5 transfer, and the B Section applies a Redundant Line (this means that the Main Hot Line overrides the Sequential Hot Line) to the Charge Circuit.

The Charger Bracket moves away from the Front Limit Switch S4 as M1B starts to run; however, all of the components continue to receive power through the B Section of K5.

The Charger Bracket moves across the Charge Plate and when it clears the Rear Tracking Guide, it hits the Rear Limit Switch S5 which moves to the Normally Open position. Now the Charge Relay K4 energizes and its contacts transfer. The B Section of K4 opens to Hot Line to M1B and K5. The Motor stops running and the contacts of K5 release. The Redundant Line to the circuit is removed, causing K3 and K4 to release.

The Paper Load Circuit consists of the Paper Load Switch, S9, the Stop-Load Solenoid, SOL 2, the Stop Load Switch, S8, and the Advance Motor, M4. The Paper Load Switch is intended for use when a new paper roll is being installed. The circuit bypasses the Advance Circuit, so that the operator can manually thread paper into the Advance Rollers. The Stop-Load components prevent the operator from feeding too much paper into the Turn-around area. This circuit is routed through the Normally Closed Contact of the Door Interlock Switch, S12, since both Doors must be opened to load paper.

The Paper Load Circuit operates in the following manner. When S9 is held down, SOL 2 energizes and releases the arm of S8. This Switch transfers its contacts, isolating the Advance Motor M4 from the Paper Feed Circuit and connecting it to be Paper Load Circuit. With M4 running, the operator can thread the paper into the rotating Advance Rollers.

As long as S9 is held, the leading edge of the paper feeds up into the Turn-around until it strikes the arm of S8, which projects through the slot in the Turn-around. When the paper raises the arm of S8, power to the motor is removed and the paper stops. When the operator releases S9, the Solenoid de-energizes and holds the arm of S8 up and out of the Turn-around slot.

The remaining circuits to be discussed below are routed through the Normally Open Contact of the Door Interlock Switch, S12, and are designed to operate with the Doors closed. These circuits are protected against shorting and overloading by the 5 Amp Fuse, F2.

The Paper-Toner Empty Circuit consists of the Out-of-Paper Switch, S11, the Toner Switch, S3, and the Empty Light L3. When the machine contains sufficient paper and toner to make a copy, this circuit routes the Main Hot Line to the circuits which allow the operator to turn the machine On. When the paper and/or the toner is depleted, this circuit re-routes the Main Hot Line to the Empty Light L3.

The Paper-Toner Empty Circuit operates as follows. When the machine is loaded with supplies, both S11 and S3 are held in their Normally Open positions and power is available to the Exact Change, CREM, and Vend Circuits. When the tail end of the paper roll clears the Loading Ramp, S11 transfers to its Normally Closed position; when the weight of the toner in the cubitainer no longer holds the scale down, S3 transfers to its Normally Closed position. In either case, power is removed from the Exact Change, CREM, and Vend Circuits, and applied to the Empty Light, L3. Any coins deposited are returned and the Free Play Switch S14 is disabled. In addition, K2C applies M.H.L. power to the Shut-Off Timer, TD, causing the last piece of paper to come out before the machine shuts off in 8 seconds.

The Exact Change Circuit consists of the Tube Switch in the Coin Mechanism, and the Exact Change Light, L4. Operation of this circuit depends on the quantity of coins in the Payout Tubes of the Coin Mechanism.

The Exact Change Circuit Operates as follows: One side of the 25¢ CREM and the Exact Change Light L4 are connected to the Main Hot Line. The other sides of both components are alternately connected to the Cold Line through the Tube or Exact Change Switch. When the Tubes contain enough coins, the switch applies a ground to the 25¢ CREM coil, and L4 stays dark. If either coin level drops below trip point, the Tube Switch de-energizes the 25¢ CREM and turns on L4. In this condition, quarters will not be accepted.

5–10¢ and 25¢ CREM Circuits consist of the Normally Closed contacts (2 and 3) of the CREM Control Relay K9, the 5–10¢ CREM, the 25¢ CREM, and the Tube Switch. The CREM's are energized whenever the machine is ready to make a copy.

The term CREM is an abbreviation of the term "Coin Return Electro-Magnet." The two electro-magnets do what the name implies; they return coins if the machine is not ready to make a copy. Both of the CREM's are mounted to the frame of the Coin Mechanism. Their Arms project through slots in the back of the Coin Acceptor, into the nickel, dime, and quarter coin paths. If a coin is deposited, the appropriate Arm will deflect the coin into Coin Return Chute. When the CREM's are energized, the arms are pulled clear of the slots and the coins continue along their paths through the Coin Mechanism.

The Vend Switch is the last component of the Pre-operative Circuits. When the coins totaling the Vend price is accepted, the Coin Mechansim sends a pulse (by closing the Vend Switch or its equivalent) to K10 in the Shut-Off Timer and K1 in the Relay Chassis. The circuit to K1 is routed through S20 in the Shut-Off Timer and the make-before-break contacts (Section A) of K1.

The circuit works in the following manner. When the Vend Switch closes, K10 energizes and transfers S21, turning the Machine On. At the same time power is applied to K1 through contacts 1 and 2 of K1A. As the relay energizes, Contact 3 of K1A makes with Contact 1, and applies the SHL to the coil of K1. Contact 2 of K1A breaks, and the Coil is now isolated from K10 and the Vend Switch. When the Vend Switch opens, K10 de-energizes but S21 remains closed because it is detented in the dwell of the ratchet cam.

The Free Play or Bypass Switch, S14B performs the same function as the Vend Switch, through the manual operation of the key by the operator. Section A of the Switch also de-energizes the Vend Counter, CTR2. In this way, only the total number of paid or vend copies is recorded automatically.

The following is a description of the continuous circuits of the prior art Model 520 machine. The machine is turned On when S21 closes. When the machine is On the Continuous Circuits are operating. All but one of the components of the Continuous Circuits will remain in operation until the Print Cycle has been completed and the machine has timed out. With the closing of S21, the Processor, Conveyor and Blower Motors start operating, driving the rollers, belt, and shafts to which they are attached. Simultaneously, the Pump starts operating. There is now Toner circulating through the Processor. With these components operating, the machine is capable of delivery a copy to the operator.

In addition to the above, the closing of S21 renders other circuits operational. Power is applied to the DC Stepper Power Supply (D4, C7, R16). Power is applied to the CREM Control Relay K9. When the relay energizes, Contacts 2 and 3 of Section A break, opening the circuit to the 5¢–10¢ CREMS. This means that the Coin Mechanism cannot accept any more coins until the machine turns Off again.

When S21 closes, power is also routed to the Knife Switch S6, Section A. Since the switch is held in the Normally Open position by the Knife 64, power is routed to Section B of K2 and through Pins 1 and 4 of the Accessory Pack Plug (a jumper connects these pins) to Section A of K1 and Section A of K2. This is where the Sequential Hot Line begins.

In the discussion on the operation of the Vend Switch, it was shown how K1 became energized through S20 and K1A almost immediately after K10 was energized. Although K1 was energized with the Continuos Circuits, it is being held on by the SHL and will remain on only until the end of the Print Cycle. This is because Section B of K1 must perform two functions: First, when the relay energizes, K1B Contacts 2 and 1 supply power to the 11" and 14" Print Switches, S2 and S7. At the end of the Print Cycle, K1 de-energizes. Now, Contacts 2 and 3 of K1B supply power to the Shut-Off Time Delay, T.D., which causes the machine to time out. This double duty performed by K1 prevents the machine from turning Off prematurely if the operator is slow in depressing one of the Print Switches, and it limits the machine to producing one copy because the Print Switches are disabled after the Print Cycle.

With power applied to the Print Switches S2 and S7, the neon Print Lights L1 and L2 glow, to indicate that a copy can be made. The Print Lights pick up a Cold Line through the coil of either K3 or K4, depending on the position of the Charger Bracket. The current drawn by the neon lamps is not enough to energize a relay so the lamps remain on until a Print Cycle is started. As soon as S2 or S7 is depressed, the same voltage is applied to both sides of the lamps and they no longer glow. At the end of the Print Cycle, power is removed from the Print Switches, so the lamps do not come on again at this point.

Since power is now applied to the Print Switches S2 and S7 and the Continuous Circuits are all in operation, the machine is ready to go through a Print Cycle.

A Print Cycle consitututes the completion of a Charge Cycle, an Exposure Cycle, an Advance Cycle, and a Cut Cycle. The operator has the option of selecting an 11" or 14" Print Cycle, which will cause minor timing variation during the Advance Cycle.

The Charge Cycle starts when K3 or K4 is energized, depending on the position of the Charger Bracket. The 14" Print Switch is connected directly to the Common Contacts of S4 and S5. One of these Switches will be in the Normally Closed position and its associated relay will energize. On the other hand, the 11" Print Switch is connected to the Flap Relay K8. Only when K8 has energized will the Charge Cycle begin.

The Charge Circuit incorporates Relays K2, K3, K4, and K5; Switches S4, S5, and S19, the Motor M1, the Thermal Cutout Relay K12, and the Power Supply. Section A of the Motor will drive the Charger Bracket from the back to the front of the Transport, if the Bracket is against the Rear Limit Switch S5. Section B will drive the Bracket from the front to the back, if the Bracket is against the Front Limit Switch S4. As the Bracket passes in front of the paper on the Charge Plate, the Corona Wire applies a high negative charge to the paper. This prepares the paper for the image projection during the Exposure Cycle.

The following description explains a Charge cycle with the Bracket starting from the rear and the operator depressing the 11" Print Switch. When S2 is depressed, K8 energizes and the relay contacts transfer. The 11" Print Switch must be held long enough for K4, K5 and K2 to energize. The voltage from S2 is routed through the A Section of the energized K8, to the A Section of the de-energized K2, and to K5C. K2 energizes and locks on through its own A Section. The B Section of K2 applies a Hot Line to the coil of K4, which transfers it contacts. Power flows to M1A through K4A and K3B and the Charger Bracket starts to move forward. The Cold and Hot Lines are also applied to the coil of K5. When K5 energizes, Section B applies a Redundant Hot Line to the Charge Circuit, and Section C applies a Hot Line to the coil of K2.

The sequence of the relays is important for two reasons. First, K8 is locked on before the Print Cycle begins, to insure that the operator gets the 11" copy size. Secondly, K2 energizes before K5 to insure that the Charge Cycle is under way before the relays lock on. When the Charger Bracket reaches the Front Limit Switch, S4, the Charger Relay K3 energizes. Sections A of K3 transfers, applying the Hot Line to the coil of K3, which locks the relay on. Section B transfers and applies a Cold Line to Section A of the Motor. All power is now removed from the Motor, the Power Supply, the Cutout Relay K12, and K5.

If, for any reason, the Charger Bracket had hung up during the Cycle and not reached the Limit Switch, the Thermal Cutout Relay would have continued to heat up. After approximately 30 seconds, the bi-metallic contact would trip the safety switch opening the Cold Line from T3 to relays K1, K2, K3, K4 and K8. This would remove power from the Charger Motor and allow the machine to time out. The machine will not be able to make another Print Cycle until the Charger Bracket is reset against a Limit Switch and the source of the problem eliminated.

Since K4 was energized at the beginning of the Charge Cycle and K3 energized when the Bracket completed a pass, the machine is ready to start an Exposure Cycle. The C Section of K3 and K4 combine to route the SHL to the Exposure Timer M2 and S17.

Before continuing with the Exposure Cycle, the double pass operation of the Charger Bracket should be understood. The purpose of a double charger pass is to provide additional charge potential under adverse conditions, such as low wintertime humidity or poor charging characteristics of the paper. Such conditions result in void areas on the copy. A double pass will take place if S19 is in the "D" position and the Charger Bracket is starting from the rear position. The only difference in circuitry is that the SHL which locks K4 on is now routed through the A Section of K3 by the Double Charge Switch S19. When the Charger Bracket hits the Limit Switch S4 and K3 energizes, Section A of K3 transfers, removing the holding voltage from K4 and applying it to the coil of K3. The Hot and Cold Lines to M1A and M1B are reversed and the Motor moves in the opposite direction, driving the Charger Bracket to the rear. When the Limit Switch S5 closes, it energizes and holds K4, and the Exposure Cycle is ready to begin. For a 14" Print Cycle, the Charge Cycle is the same, except that S7 energizes K3 or K4 directly, instead of being routed through K2B first.

To help clarify the operation of the Charge Bracket Motor M1 and its control components S4, S5, K3, K4, and S19, the following examples of a typical operation are given:

1. SINGLE CHARGER PASS

Given the following conditions:

S19 on "S" or "single charger pass" position.
S4 open.
S5 closed—corona bracket at the rear or right.
K2 energized.

SHL power flows through K2B to S4. The front (or left-hand) limit switch S4 is open, so K3 is not energized at this time. However, the following contacts on K3 are now "hot".

K3A2
K3A3
K3C1

SHL power continues on to S5, the rear (or right-hand) limit switch. In this case, current flows through S5 because the switch is closed, *energizing K4.* Relay K4 latches itself to the SHL through K4A2 and S19 "S". In addition, the following takes place:

K4B supplies direct ground connections for the K12(4) heater, the Corona Power Supply, and the bottom end of Relay K5, which pulls in immediately.

K4A2 also supplies current (a "hot" line) to K12(1), the Corona Power Supply, Section M1A of the Corona Bracket Motor and to the top of Relay K5.

The Motor runs, moving the Charger toward the front (left) immediately allowing S5 to open. The opening of S5 has no effect at this time since power is not being drawn from the SHL and pre-operative line through S19, K4A2, and K5B2, respectively. When the Charger nears the end of its forward travel, Limit Switch S4 is closed and K3 is energized. K3 is held on through K3A2. Contacts K3B transfer, breaking the current flow to:

K12
Corona P.S.
M1A
K5 coil

Once the motor has stopped, the heater of K12 begins to cool and the Corona Power Supply is shut down. K3C and K4C now form a complete circuit for the energizing of Relay K6 through S17, causing the Exposure Lamps to light. This ends the single charge cycle.

2. DOUBLE CHARGER PASS

Given the following conditions:

S19 on "D" or "double charger pass" position.
S4 open.
S5 closed—corona bracket at the rear or right.
K2 energized.

SHL power flows through K2B to S5, energizing K4. Contacts K4A transfer, holding K4 pulled in through S19 and K3A. S19 prevents K4 from being self-holding. The motor (M1A) runs as described in paragraph one and the other functions take place in the same manner until the charger bracket closes S4. At this time, K3 energizes, K3A transfers and K4 de-energizes. Now the connections to the Motor have been reversed, and since we have frustrated its aim to close both K3 and K4, M1B hurries the Charger Bracket back to finish the job by closing S5 once again. Now both relays remain pulled in and the exposure cycle is ready to commence.

The Exposure Cycle can begin only when both K3 and K4 are energized, and the C Sections of the two relays route the SHL to the Exposure Timer Assembly. The Exposure Circuit consists of the Timer Motor M2, the Exposure Control Switch S17, the Exposure Relay K6, Exposure Lamps L5, L6, L7 and L8 for all copies, and the Anti-Spike Transformer and Resistor, T3 and R5. The Exposure Lamps provide the light which is reflected off the original through the lens, off the mirror, onto the charged paper on the transport.

The Exposure Circuit operates in the following manner: When the SHL circuit is completed through the C Sections of K3 and K4, the Exposure Control Switch S17 routes the SHL to the coil of K6. The relay energizes and its heavy duty contacts complete a circuit from the Main Hot Line, through the Anti-Spike Transformer to the Exposure Lamps. The Hot Line to the lamps bypasses the 5 Amp Fuse F2 because the current drawn by the lamps would blow the fuse immediately.

When the lamps are first illuminated, there is a voltage drop in the circuit. This drop goes through the Secondary Winding of T3 and creates a corresponding voltage in the Primary Winding of the Transformer. The voltage is phased so that it adds to the voltage across relays K1, K2, K3, K4 and K8. If this "anti-spike" voltage were not present, the surge to the lamps would take away from the holding voltage to the relays and they would drop out.

At the same time K6 was energized, voltage was applied to the Exposure Timer Motor M2. This Motor drives a cam, whose starting position is determined by the setting of the Exposure Dial. The rotating cam measures the exposure time and then trips the Exposure Control Switch S17. When S17 transfers from its Normally Closed to Normally Open position K6 de-energizes, ending the Exposure Cycle. The SHL is still applied to the Motor M2 which prevents the cam from resetting. This, in turn, holds S17 in the tripped position and the SHL is routed through the Normally Open Contact to the Advance Circuit.

The Advance Circuit consists of the Advance Motor M4, the Stop Load Switch S8, the Quad Cam Switch S10, the Stepper Relay K11, S13 and S18, the B Section of K7, the B Section of K8, the Advance Brake Circuit D2, C4, C5, R11, and R12, and the Counter CTR1.

The sequence for the Advance Cycle is as follows: The SHL is routed from S17 through the B Section of K18 through the closed contacts of the Motor Coast Relay K19, through K7B and the Stop-Load Switch S8, to the Advance Motor M4. Power is also applied to the Advance Brake Circuit. The Diode D2 converts the A.C. voltage to pulsating DC and the Capacitors begin storing a charge. Power is applied to the Counter CTR 1 which energizes and remains this way for the duration of the cycle.

Power is also applied to the Quad Cam Switch S10. When the Advance Rollers turn, the Quad Cam trips the Switch S10 for each half inch of paper fed. When S10 closes, K11 energizes and when S10 opens, K11 de-energizes, advancing the Ratchet Cam and wiper of S13 one step. This sequence is repeated until S13 reaches the 10½" or 13½" motor coast contact. If K8 is energized, (the 11" print button was pressed) K19 will energize when S13 reaches the 10½" motor coast contact. If the 14" print button was pressed, K8 was not energized and S13 can only activate K19 when the 13½" motor coast contact is reached. Note that as soon as the Ratchet Cam steps the first time, it releases the S18 Contacts and the Switch closes. Contacts 5 and 6 of S18 supply a redundant hot line to the Advance Circuit, which will allow the Advance Cycle to continue if the SHL is interrupted.

Accordingly, when K7 energizes, the A Section transfers and routes the MHL to the knife Motor M3 and to the Dole Valve Solenoid, SOL3. The knife 64 starts to close and the toner receives a measured shot of concentrate. As the SHL is broken, Relays K1, K2, K3, K4, K5 and K8 drop out. Motor M2 is released, allowing S17 to reset to its normally closed position. K7 remains energized long enough to allow M3 and SOL3 to start doing their jobs because S13 must advance three more steps before clearing all the jumpered contacts, after which time K7 is free to drop out. By the time K7 drops out, S6 has transferred its contacts and S6B now passes Knife Motor M3 and Dole Valve SOL3 current, allowing the Cut Cycle to finish. When S6 is restored to its Normally Open Position, SHL power is again available at K1 to begin a new cycle.

In the meantime, the Stepper Relay K11 must return S13 to its home position. This is done when S6A first closes, energizing K17. Contacts K17C transfer, causing K18 to drop out. This prevents any possibility of pulsing the stepper accidentally. Contacts K17A apply the MHL to contact 3 and 4 of S18, keeping K17 locked in until S13 has homed and also providing K11 and buzzer contacts K11A with continuous power until S13 reaches home position and opens S18.

If power to the machine is interrupted, these contacts will allow the Advance Cycle to resume where it left off once power is re-applied. The number of steps and in effect the length of the copy is determined by the B Section of K8. If K8 is energized, there will be 28 steps for a 14" copy. This is because the wire on the 28th position of the Stepper Switch is routed through the B Section of K8 to the coil of K7. The wire on the 22nd step of S13 also goes to K7 through to the coil of K7. The wire on the 22nd step of S13 also goes to K7 through K8B, and the paper must advance 22 half inches—11 inches—to reach this tab. When the wiper reaches the selected tab, K7 energizes. The A Section of K7 locks the relay on, while the B Section opens the power circuit to the Advance Motor and connects the Braking Capacitor around the Diode to the Motor. The C Section of K7 is used to prevent power from reaching the Print Buttons S2 and S7 during the Advance Cycle.

If either the 22nd or 24th contact of S13 is broken, a series of three jumpers, called the "safety" circuit are connected to tabs 22 or 24 respectively, and will energize K7 and complete the Advance Cycle. Naturally, the copy will end up at least ½" longer than the desired size indicating a need to check S13's contacts.

The Cut Circuit consists of the Knife Motor M3, the Knife Switch S6, and the A Section of K7. The Knife cuts the paper at the desired length and trips Switch S6 which signals the end of the Print Cycle. It is during the Knife Cycle that the Stepper Relay K11 is reset to home position. K11 is reset and protected by K11A, S18, K27 and K18.

The Cut Circuit operates as follows: When K7 energizes, the A Section transfers and routes the MHL to the Knife Motor M3 and to the Dole Valve Solenoid, SOL 3. The knife starts to close and the toner receives a measured shot of concentrate. As the SHL is broken, Relays K1, K2, K3, K4, K5 and K8 drop out. Motor M2 is released allowing S17 to reset to its normally closed position. K7 remains energized long enough to allow M3 and SOL 3 to start doing their jobs because S13 must advance thru more steps before clearing all the jumpered contacts, after which time K7 is free to drop out. By the time K7 drops out, S6 has transferred its contacts and S6B now passes knife Motor M3 and Dole Valve SOL 3 current, allowing the cut cycle to finish. When S6 is restored to its Normally Open position, SHL power is again available at K1 to begin a new cycle. The B Section of K1 no longer supplies a Hot Line to the Print Switches S2 and S7, so the Switches are disabled and the Print Lights L1 and L2 do not glow. The Hot Line from S21 is routed through the B Section of K1 and back to T.D. in the Shut-Off Timer. The Timer runs for the pre-determined time (approximately 8 seconds) and trips S20. This causes K10 to energize and open the S21 Contacts. Power is removed from all the Continuous Circuits and the machine is off. The CREM Control Relay K9 de-energizes and power is re-applied to the 5-10¢ and 25¢ CREM's provided that paper, toner, and change are available. The machine is ready for another vend.

LIST OF COMPONENTS FOR THE MODEL 520 PRIOR ART MACHINE OF FIGS. 1, 2, 10A and 10B

LAMPS & INDICATORS

| Element No. | Part |
|---|---|
| LL1 | Print 11" |
| L2 | Print 14" |
| L3 | Empty |
| L4 | Exact Change |
| L5 | 14" Exp. Lamp |
| L6 | 14" Exp. Lamp |
| L7 | Exp. Lamp Common |
| L8 | Exp. Lamp Common |
| L9 | Rail Lamp |
| L10 | Rail Lamp |
| L11 | AD Sig'n Lamp |
| L12 | AD Sig'n Lamp |
| L13 | Wash-out Lamp |
| L14 | Wash-out Lamp |
| L15 | Wash-out Lamp |

COUNTERS

| Element No. | Part |
|---|---|
| 1 | Copy or Total |
| 2 | Coin Vend |

DIODES

| Element No. | Part |
|---|---|
| D2 | Advance Brake |
| D4 | Stepper Power Supply |

RELAYS

| Element No. | Part |
|---|---|
| K1 | Print Control (R/C) |
| K2 | Print Start R/C |
| K3 | Charge (R/C) |
| K4 | Charge (R/C) |
| K5 | Charge Control (R/C) |
| K6 | Exp. Lamp (R/C) |
| K7 | Cut (R/C) |
| K8 | Flap (R/C) |
| K9 | CREM Control |
| K10 | Shut-off Timer |
| K11 | Stepper (R/C) |
| K12 | Charger Thermal (R/C) |
| K17 | Stepper Control Relay (R/C) |
| K18 | Stepper Isolating Relay (R/C) |
| K19 | Motor Coast Relay (R/C) |

MOTORS

| Element No. | Part |
|---|---|
| M1A | Charger |
| M1B | Charger |
| M2 | Exposure Timer |
| M3 | Cut |
| M4 | Advance |
| M5 | MCS (optional) |
| M6 | Blower |
| M7 | Processor |
| M8 | Conveyor |
| M9 | Pump |
| T.D. | Shut-Off Timer (Solid State) |

SWITCHES

| Element No. | Part |
|---|---|
| S1 | Humidistat Switch |
| S2 | Print Switch 11" |
| S3 | Toner |
| S4 | Charger Front Limit |

-continued

| | |
|---|---|
| S5 | Charger Rear Limit |
| S6 | Knife Control |
| S7 | 14" Print |
| S8 | Stop Load |
| S9 | Paper Load |
| S10 | Stepper Advance |
| S11 | Out-of-Paper |
| S12 | Interlock |
| S13 | Stepper |
| S14 | Free Play Key |
| S16 | Circuit Breaker - 15 amp. |
| S17 | Exp. Control Micro. |
| S18 | Stepper Control |
| S19 | Double Charge |
| S20 | Shut-Off Timer Micro. |
| S21 | Shut-Off Timer Power |
| S22 | Charger Peak |
| S24 | Float Switch |

SOLENOIDS & ELECTRO MAGNETS

Sol. 1
Sol. 2
Sol. 3
5¢-10¢ CREM
25¢ CREM

RESISTORS

| Element No. | Part |
|---|---|
| R5 | 60 ohm |
| R11 | 50 ohm |
| R12 | 100 K ohm |
| R13 | 220 ohm |
| R15 | 100 ohm |
| R16 | 100 K ohm |

CAPACITORS

| Element No. | Part |
|---|---|
| C4 | 300 ufd. |
| C5 | 300 ufd. |
| C6 | 0.5 ufd. |
| C7 | 50 ufd. |
| C9 | 0.5 ufd. |
| C10 | 0.5 ufd. |
| C11 | 0.5 ufd. |
| C12 | 0.5 ufd. |
| C13 | 0.5 ufd. |

TRANSFORMERS

| Element No. | Part |
|---|---|
| T2 | Rail Lamp X-former |
| T2 | Wash-out Lamp X-former |
| T3 | anti-spike X-former |

MISCELLANEOUS

Hi-Voltage Power Supply
Ht. 1 Cabinet Heater
F2 - 5 amp fuse
Vend Switch - Coin Mech.
Ballast - Sign Lamps The foregoing description of the electrical operation of the prior art Olivetti Model 520 copier is a paraphrase of the description of machine operation provided by the manufacturer of the prior art device. In order to convert the prior art electronics as shown in FIGS. 10A and 10B to the improved electronics illustrated in FIGS. 12A, 12B, 13 and 14, it is first necessary to remove certain of the elements from the preceeding list of components and rewire some of the remaining elements so that they can accept the electronics of Module A and Module B as illustrated in FIGS. 13 and 14 respectively. Out of the preceeding prior art parts list the following elements are removed in their entirety:

ELEMENTS REMOVED FROM THE PRIOR ART MODEL 520 MACHINE

LAMPS & INDICATORS

| Element No. | Part |
|---|---|
| L9 | Rail Lamp |
| L10 | Rail Lamp |
| L13 | Wash-out Lamp |
| L14 | Wash-out Lamp |
| L15 | Wash-out Lamp |

MOTORS

| Element No. | Part |
|---|---|
| M1A | Charger |
| M1B | Charger |
| M7 | Processor |
| M8 | Conveyor |

SWITCHES

| Element No. | Part |
|---|---|
| S1 | Humidistat Switch |
| S4 | Charger Front Limit |
| S5 | Charger Rear Limit |
| S22 | Charger Park |
| S24 | Float Switch |

RELAYS

| Element No. | Part |
|---|---|
| K6 | Exp. Lamp(R/C) Replaced with Iraic A |

MISCELLANEOUS

Hi-Voltage Power Supply
Ht 1 Cabinet Heater

In addition to the foregoing the following items are not removed, but their function is substantially changed by the rewiring of the electronic components as shown in FIGS. 12A, 12B, 13 and 14.

PRIOR ART ELEMENTS WITH MODIFIED FUNCTIONS (BUT NOT REMOVED)

| Element No. | Part |
|---|---|
| M16 | Blower |
| S17 | Exposure Control Micro Switch |
| S19 | Double Charge Switch |
| T2 | Rail Lamp Transformer |
| T2 | Wash-out Lamp Transformer |

In view of the foregoing, the following items are specifically retained or are retained and required with modified functions from the prior art device illustrated in FIGS. 1, 2, 10A and 10B.

LIST OF ELECTRONIC COMPONENTS RETAINED FROM THE PRIOR ART MODEL 520 MACHINE

LAMPS & INDICATORS

| Element No. | Part |
|---|---|
| LL1 | Print 11" |
| L2 | Print 14" |
| L3 | Empty |
| L4 | Exact Change |
| L5 | 14" Exp. Lamp |
| L6 | 14" Exp. Lamp |
| L7 | Exp. Lamp Common |
| L8 | Exp. Lamp Common |
| L11 | AD Sig'n Lamp |
| L12 | Ad Sig'n Lamp |
| L13 | Exposure Lamp |

LIST OF ELECTRONIC COMPONENTS RETAINED FROM THE PRIOR ART MODEL 520 MACHINE

COUNTERS

| Element No. | Part |
|---|---|
| 1 | Copy or Total |
| 2 | Coin Vend |

DIODES

| Element No. | Part |
|---|---|
| D2 | Advance Brake |
| D4 | Stepper Power Supply |

RELAYS

| Element No. | Part |
|---|---|
| K1 | Print Control (R/C) |
| K2 | Print Start (R/C) |
| K3 | Charge (R/C) |
| K4 | Charge (R/C) |
| K5 | Charge Control (R/C) |
| K7 | Cut (R/C) |
| K9 | CREM Control |
| K10 | Shut-Off Timer |
| K11 | Stepper (R/C) |
| K12 | Charger (R/C) |
| K17 | Stepper Control Relay (R/C) |
| K18 | Stepper Isolating Relay (R/C) |
| K19 | Motor Coast Relay (R/C) |

MOTORS

| Element No. | Part |
|---|---|
| M2 | Exposure Timer |
| M3 | Cut |
| M4 | Advance |
| M5 | MCS (optional) |
| M6 | Blower |
| M9 | Pump |
| T.D. | Shut-Off Timer (Solid State) |

SWITCHES

| Element No. | Part |
|---|---|
| S2 | Print Switch 11" |
| S3 | Toner |
| S6 | Knife Control |
| S7 | 14" Print |
| S8 | Stop Load |
| S9 | Paper Load |
| S10 | Stepper Advance |
| S11 | Out-of-Paper |
| S12 | Interlock |
| S13 | Stepper |
| S14 | Free Play Key |
| S16 | Circuit Breaker - 15 amp. |
| S17 | Exp. Control Micro. |
| S18 | Stepper Control |
| S19 | Double Charge |
| S20 | Shut-Off Timer Micro. |
| S21 | Shut-Off Timer Power |

SOLENOIDS & ELECTRO MAGNETS

Sol. 1
Sol. 2
Sol. 3
5¢-10¢ CREM
25¢ CREM

RESISTORS

| Element No. | Part |
|---|---|
| R5 | 60 ohm |
| R11 | 50 ohm |
| R12 | 100K ohm |
| R13 | 220 ohm |
| R15 | 100 ohm |
| R16 | 100K ohm |
| R17 | 10K ohm (added) |

CAPACITORS

| Element No. | Part |
|---|---|
| C4 | 300 ufd. |
| C5 | 300 ufd. |
| C6 | 0.5 ufd. |
| C7 | 50 ufd. |
| C9 | 0.5 ufd. |
| C10 | 0.05 ufd. |
| C11 | 0.5 ufd. |
| C12 | 0.5 ufd. |
| C13 | 0.5 ufd. |
| C20 | 1.0 ufd (added) |

-continued

TRANSFORMERS

| Element No. | Part |
|---|---|
| T2 | Rail Lamp X-former |
| T2 | Wash-out Lamp X-former |
| T3 | Anti-spike X-former |

MISCELLANEOUS

F2 - 5 Amp Fuse
Vend Switch - Coin Mech
Ballast - Sign Lamps
Triac A - Added

Note that Triac A has been added to the basic circuit to replace relay 166. In addition a standard gating capacitor C20 has been added between the gate of Triac A and Module A.

In general the elements retained in the converted electronic circuitry as illustrated in FIGS. 12A, 12B, 13 and 14 retain the same alpha-numeric designation as the elements illustrated in the prior art circuitry of FIGS. 10A and 10B.

The basic circuitry of the converted machine is illustrated in FIGS. 12A and 12B. It is well within the knowledge and capability of one of ordinary skill in the art to make the modifications necessary to transform the prior art circuit of FIGS. 10A and 10B into the converted circuit of FIGS. 12A and 12B given this teaching. In fact, field conversions have been made with a minimum of difficulty using essentially the same instructions. The converted circuit of FIGS. 12A and 12B include two circuit boards identified as Module A and Module B. Module A is described in detail in FIG. 13. Similarly, Module B is described in detail in FIG. 14. The circuitry and fabrication of Modules A and Modules B is well within the knowledge and ability of one of ordinary skill in the art given this teaching. A parts list describing specific circuitry is included in a subsequent portion of this disclosure.

The following is a description of the electrical operation of the converted Model 520 copier. In order to facilitate a complete understanding of its operation, the complete description of the machine operation will be given even though large portions of it are redundant with respect to the description of the unconverted Model 520 operation described earlier.

To facilitate this description the basic copying sequence of operation will be outlined, emphasizing the inter-relationships among the various relays, switches, clutches, power supplies, timers, and the new conversion circuitry. Whereever appropriate, switch and relay closures or new circuit functions will be described to maintain a logic AC and DC signal flow throughout the system during a print cycle. The Print sequence operates in the following manner. When the 15 ampere circuit breaker MASTERSWITCH S16 is closed, 120-60 Hz ac power is available for all of the printing circuits.

After the MASTERSWITCH is closed, the VEND or the FREE-PLAY switch S14 must then be activated through the PAPER switch S11 to prepare the remaining circuitry for printing. The SHUT-OFF TIMER POWER switch S21 can then receive ac power and is considered the initial starting point for all of the printing functions. It should be remembered that S21 must be closed throughout the entire printing cycle and at the conclusion of this cycle, it will open automatically turn the unit off.

Assume that 8" of uncharged Bond paper has been prefed, by a previous print cycle, slightly ahead of the unit's paper feed rollers. When the machine is "vended", the momentary contact VEND switch energizes Relay K10, closing switch S21. Ac power can then be supplied to Relay K1, the three-section PRINT CONTROL RELAY. Notice the coil of this relay is energized by the VEND or FREE-PLAY S14B through the normally closed contact of S20. Section A of K1 has "make-before-break" contacts which are used to energize the relay and hold it energized while the relay is in the switch mode. Section B of K1 supplies power to the 11" and 14" Print Buttons for a single copy through Relay contact K7-C. The TONER PUMP, BLOWER, DISCHARGE/TRANSFER HIGH-VOLTAGE POWER SUPPLY, RELAY K9, the DC BIAS POWER SUPPLY, and the DC STEPPING POWER SUPPLY are other networks that receive ac power after "vending".

In addition, the EXPOSURE TIMER M2 is activated. After approximately one second (which is internally adjustable), the toner has reached the drum and the EXPOSURE TIMER closes switch S17, distributing additional ac power to the DRIVE MOTOR, and TIMER 2, (the ac time delay circuit). K11, S10, S13-common, and the common and normally closed contacts of Relay K17 and K18 also receive ac power.

With the DRIVE MOTOR activated, the selenium drum 18 begins to rotate as a +450 V dc bias voltage is applied to the TONER TANK trough plate 58. The drum 18 makes at least one complete revolution past a cleaning station (roller 82 and blade 84) and through the low electrostatic field generated by +450 V dc potential. As the drum 18 rotates, it is cleaned of any residual toner particles deposited on the drum during a previous print cycle. When the TIMER 2 circuitry times-out, it terminates the cleaning cycle and the unit is ready to receive a PRINT command. Either 11' or 14' copies can be made using the converted copier, but for this discussion it will be assumed that an 11' copy is required.

When the momentary 11' PRINT switch is closed, Relay K8 is energized and will be "latched" ON by Section K8-A. This also "latches" Relay K2 ON and after the 11" PRINT switch is released, Relay K2 is cross-coupled with Relay K8 to maintain a dual "latched-ON" condition. Relay K4 is energized through Relay K2 Section K2-B and S5. Relay K5 turns ON supplying ac power to the +24V DC CLUTCH POWER SUPPLY. Since TIMER 2 has timed-out, the HIGH VOLTAGE CHARGING POWER SUPPLY receives ac power as well as Triac A. Triac A then turns ON the EXPOSURE LAMP.

The unit's EXPOSURE LAMP will not reach its full printing brilliance immediately and similarly the HIGH-VOLTAGE CHARGING POWER SUPPLY will also require a short period of time to stabilize to the proper charging voltage. Therefore, solid-state dc time delay will prevent the FORWARD CLUTCH from engaging for approximately one-half a second after ac power is applied to the input of the +24 V DC CLUTCH POWER SUPPLY. After this brief interval, the charging voltage is at a maximum, the scanner starts its advance, and the print cycle begins.

At this juncture most of the unit's internal circuitry is active. As the scanner lamp 24 begins its lateral motion, S5, which was held in the normally open position by the scanner head mechanism, switches to its normally closed position. However, this has no effect on the ac conditions established to this point. The scanner head then engages several micro-switches. The B-section, designated the PAPER START section, turns ON the PAPER ADVANCE MOTOR, charges the PAPER ADVANCE MOTOR'S dc braking network, activates the paper advance sensor S10, and signals S13's sensor ISOLATION AMPLIFIERS. This insures that the Bond paper and the drum's image will coincide when transfer takes place. (This will be explained in detail in a later section of this disclosure). As S10 tracks the paper's forward motion, the ISOLATION AMPLIFIERS signal K11 through Section K17-B. This pulses S13 along synchronously with the paper motion. As a result of these electronic controls and solid-state circuitry, every one-half inch of advancing paper "steps" S13 exactly one position.

When the stepping switch, S13, reaches the position that applies ac power to the MOTOR COAST RELAY through Relay K8 Section K8-C, the PAPER ADVANCE MOTOR'S ac power is turned OFF. The motor continues to coast due to its own inertia and provides one additional stepping advance signal to S13 from S10.

At this point, ac power is directed from S13-common through K8-B to Relay 17. When Relay K7 closes, Section K7-B connects the dc braking voltage directly to the PAPER ADVANCE MOTOR immediately stopping the motor and the paper advance. When braking occurs, exactly 3" of Bond paper has been fed from the unit's paper roll toward the selenium drum. This coupled with the 8" of paper prefed during the previous printing cycle totals precisely 11" of paper.

Relay K7, Section K7-A, applies ac power to the knife motor that cuts the paper for an 11" copy. The unit's cutting action is a solenoid-type motion and the blade 64 traverses the full 8 ½" width of the paper engaging the CUT SWITCH S6. The brief CUT SWITCH S6 closure sends an ac pulse to the coil of Relay K17 and to Section K17-C. Section K17-A supplies ac power to K11's coil (on the side opposite the rectifier D4) and produces a rapid stepping of S13 "homing" it to its original starting position. When S6 opens, K1 de-energizes and applies ac power to the solid-state turn-off timer TD. Before the Bond paper actually reaches and contacts the unit's drum 18, the scanning head has started to scan the copy and expose the drum to the image through its optical system. The drum rotates synchronously with the scanner's lateral motion. The drum first contacts the high ac discharging field 88 that neutralizes the drum's surface and brings the drum to nearly ground potential. The drum then rotates past the high-voltage electrode 90 (+6400 V dc) that bathes the drum in an electrostatic field, charging the surface to a high potential. The charged drum surface passes in front of the optical system aperture and is exposed to the copy image. With this "positive" printing system, the intense light focused on the drum's surface through the aperture will quickly discharge the surface to a low-voltage, typically less than +500 V dc. The absence of light through the aperture will not affect the surface charge at all. Therefore, for a printed page, e.g., typewritten material on a white background, the drum's high-voltage surface charge will be unaffected where the type-written material is focused and totally removed (certainly considerably reduced) wherever light is focused on the drum. The system is quite linear and between the extreme black-to-white transitions in exposure the system can reproduce a gray-scale.

As the drum surface leaves the exposing aperture, the lateral surface potential is directly proportional to the original copy. If the drum could be stopped and a sensitive voltage probe used to measure the lateral surface charge on the drum, the voltage would fluctuate from approximately +500 V dc to +6400 V dc; these voltages readings would correspond exactly to the original copy. White spaces would read low in voltage and black printing would read high in voltage; the readings between these two extremes is representative of gray-scale.

The drum continues and passes through the toner bath 58. The TONER PUMP 172 simply floods the charged drum 18 with negatively charged toner through a narrow meniscus across the full width of the drum. With the drum 18 charged positive and the toner charged negative, the toner particles are attracted to the positive charge on the drum surface. Where the surface charge is high, many toner particles are attracted to the drum; where the surface charge is low, fewer toner particles are attracted to the drum.

Some of the toner particles attracted to the drum are randomly spaced and have no correlation to the original copy. These particles generally represent "noise" in the system and would create a dark or dirty background on the copy. Fortunately, these particles are loosely coupled to the drum surface at voltages less than +400 V dc. Therefore, after the toner is applied to the drum's surface, the drum 18 passes the toner plate that is still biased to +450 V dc. The TONER TANK trough plate 58 once again cleans the drum surface of these loosely coupled particles. The copy image, now attached to the drum in the form of precisely spaced toner patterns, is unaffected by the +450 V dc plate cleaning voltage because the true image is at a potential greater than +450 V dc.

The image now leaves the toner bath and background cleaning plate and synchronously meets with the Bond paper just ahead of the transfer corona 72. It is here, at the transfer corona 72 where the image will be transferred from the drum to the Bond paper. The corona charges the backside of the Bond paper to a high positive potential essentially "pulling" the image from the drum to the paper.

Meanwhile, the scanner has completed the scan of the original copy and closes switch S4, turning Relay K3 ON and K4 OFF. This reverses the ac line voltage to the +24 V DC CLUTCH POWER SUPPLY which has no effect on the basic operation of the supply. However, switching the line voltage between K3 and K4 places the same side of the ac line across the CLUTCH RELAY, the HIGH-VOLTAGE CHARGING POWER SUPPLY, and Triac A. As a result the charging voltage drops to zero volts, the EXPOSURE LAMPS turn OFF, and the scanner reversing clutch engages. The scanner now begins its lateral return to the original starting position.

Relay K3 Section K3-C sends ac power back to the PAPER ADVANCE MOTOR because S4 is again normally closed and K7 and K19 are de-energized since S 13 has "homed." As the paper advances, S10 and the S13 ISOLATION AMPLIFIERS (on Module-B) again track the paper's motion. For every one-half inch of the paper's forward motion, the stepper switch S13 advances exactly one position. When the stepper switch connects ac power to the MOTOR COAST RELAY K19, the PAPER ADVANCE MOTOR turns OFF. The unit has now prefed 8" of Bond paper for the next printing cycle.

Shortly after the scanner leaves S4, S4 returns to its normally closed position and the scanner once again closes A-section of the micro-switches, designated as the BIAS SWITCH section. When the A-section closes, the BIAS RELAY is energized and the cleaning voltage applied to the TONER TANK is reversed, i.e., +450 V dc to −450 dc.

The copy image, that is on the drum, and the Bond paper synchronously meet just before contacting the TRANSFER HIGH-VOLTAGE POWER SUPPLY 72 and are fed together through the electrostatic field generated by this power supply. This power supply produces a strong field (+5800 V dc) on the back side of the paper and it is greater than the field that is now holding the image to the selenium drum. Since the paper is between the transfer field and the drum, the image is transferred from the drum to the paper. Through a series of pick-off "fingers" 82 and upper "turnaround" guides 76 and 78, the copy is lifted from the drum 18 and directed to an EXIT tray 219. The drum, of course, has a slight covering of toner that has been pressdryed to its surface during the transfer process. This must be cleaned from the surface. The drum continues to rotate past the cleaning roller 82 and blade 84 and 86 that will remove the major portion of the residue. The drum continues its rotation to a toner bath where toner is pumped onto the surface moistening the surface for a final cleaning application. The drum surface is not charged to a significant potential at this point and the cleaning toner bath will not be attracted to the drum's surface. The damp drum is "scrubbed" by cleaning roller 62 and the surface is essentially cleaned and prepared for the next printing cycle.

During the printing cycle the toner trough plate 58 was at +450 V dc to provide an extra cleaning cycle before printing. The plate collected small toner particles from the drum surface to produce a clean background on the copy. During this operation the plate generally collects a substantial number of these particles. As the scanner is returning to its original position the toner plate voltage is reversed. This drives the particles from the toner plate and back into the toner solution. Therefore, the toner plate is also cleaned.

The scanner reaches its original starting position and switches S5 from its normally closed position to its normally open position. Relay K5 then turns OFF, Relay K4 turns ON, and the +24 V DC CLUTCH POWER SUPPLY turns OFF. The drum drive motor remains ON continuing the cleaning operations. Within a few seconds the solid-state shut-off timing unit times-out de-energizing Relay K8 and shuts down the ac power to all of the unit's circuits.

The following technical discussion outlines the sequential operation of the converted Copier from the initial application of ac power to the actual PRINT condition. When PRINT is initiated, many events occur simultaneously. Therefore from the beginning of the PRINT condition to the final SHUT-OFF step, the electrical operation of the unit is described in a logical signal-flow manner but not necessarily in sequential order.

When the unit is "plugged-in", ac power is immediately distributed to the following networks:

S16 Master Switch—Circuit Breaker

S16 is a single-pole single-throw 15 amp, circuit breaker. When turned on, this switch supplies power to all of the components shown in FIG. 1.

S22 Charger Park Switch

S22 is a single-pole double-throw switch. When manually depressed, this switch completes a circuit to the coil of K3, causing the Scanner to move from right-to-left. K3 is not shown in FIG. 1 but is described in Section K3.

S12 Door Interlock Switch

S12 is a single-pole double-throw switch. It is actuated by the Front Panel Doors. It must be closed to supply ac power to the VEND switch.

S11 Out-of-Paper Switch

S11 is a single-pole double-throw switch. It is actuated by the paper roll. In the normally open position, this switch partially completes a circuit to the CREM's the Free Play Switch, and the Coin Mechanism. In the normally closed position, it completes a circuit to the Empty Light L3.

S3 Toner Switch

S3 is a single-pole double-throw switch. It is held open by the weight of the Copiatoner Container. In this open position, the switch partially completes a circuit to the CREM's, the Free Play Switch, and the Coin Mechanism. In the normally closed, it completes a circuit to the Empty Light L3 through contact K2C.

S14 Free-Play Switch

S14 is a momentary contact switch. Section B of this switch will activate K10 in the SHUT-OFF Timer to turn the unit ON, and K1 in the relay chassis to activate switches S2 and S7. Section A opens when a Free-Play is generated to inhibit the Vend Counter (CTR#2).

Vend Switch

This can be microswitch, a printed-circuit switch, or an electronic pulse, depending on the brand and model changer used. The switch pulses K10 in the Shut-Off Timer to turn the machine ON, and K1 in the Relay Chassis to activate the PRINT Buttons S2 and S7. It is similar in operation to the FREE-PLAY SWITCH.

5–10¢ CREM

A relay coil with two projecting arms. This coil is energized whenever the machine is plugged in, loaded with supplies, and not running. Nickels and dimes can be inserted only when the coil is energized.

25¢ CREM

A relay coil with one projecting arm. This coil is energized whenever the machine is available for use (see 5–10¢ CREM) and sufficient change is in the tubes. Quarters can be inserted only when the coil is energized.

L4 Exact Change Light

This lamp is ON whenever the coin tubes in the changer are low on coins and the Tube Switch is in its normally closed position.

The relay contacts of K5-B and K9-A will be described in relay sections titled K5 and K9. When the machine is "VENDED", relay coil K1 will be energized and latched ON supplyingac power throughout the system. As K1 latches, M2 (TIMER (1) receives ac power activating S17. When S17 closes, ac power is directed toward the Stepper switch and the several relay contacts that control the "stepping" function.

K1 Print Control Relay

K1 is a three-section relay. The coil of this relay is energized by the VEND switch or the FREE-PLAY switch section S14-B. This occurs through the normally closed contacts of S20. Section K1-A has "make-before-break" contacts that are used to energize the relay (K1) and hold it energized while the relay is switching over. When the "switch-over" is complete, the relay is kept energized through contacts K1-A and switches S6 and S21. Section K1-B supplies power to the 11" and 14" Print Buttons for a single copy through contact K7-C. Section K1-C is used to prevent the Motor Coast Relay K19 from stopping the paper advances during the 13½" motor coast position. This is a possibility if the power to relay K1 is interrupted.

S20 Automatic Shut-Off Switch

S20 is a single-pole double-throw switch that is part of the Solid-State Timer. This switch partially completes the circuit to K1 during the latching of K1. It also completes the circuit to K10 in its normally open position whenever T.D. has completed its timing out procedure.

K10 Shut-Off Timer Relay

K10 is a ratchet-type relay coil. This coil is energized by the VEND or FREE-PLAY Switch to turn the machine ON and by S20 to turn the machine OFF. This coil closes the contacts of S21 each time it is energized.

S21 Shut-Off Timer Power Switch

S21 is a single-pole single-throw ratchet-type switch. This switch alternately applies or removes power from the unit whenever relay K10 is energized.

S6 Knife Switch

S6 is a double-pole double-throw switch. Section A completes the circuit to latch K1 in the normally open position. Section A completes the circuit to the Stepper Control Relay K17 in the actuated (normally closed) position. Section A and Section B combine in the actuated (normally closed) position to complete the circuit which returns the Cut Motor M3 to the home position.

Solid-State Shut-Off Timer (T.D.)

A transistorized timer. At the end of the timing cycle, this timer activates S20 to automatically turn the unit OFF. The shut-off details are explained later.

M6 Blower Motor (202)

A motor that runs as long as S21 as closed. It is responsible for drying the copy and eliminating heat from lamp.

M9 Toner Pump (172)

This pump runs intermittently as long as S21 is closed. It is responsible for culcullating the toner.

M2 Exposure Timer-1 Motor

M2 is a synchronous motor. It is energized by S21.

S17 Exposure Timer Control Switch S17 is a single-pole double-throw microswitch. It is activated by M2 distributing ac power to S13 and its associated relays (TAKE-OFF B).

D4, R15, R16, C7 Stepper Relay Power Supply

These components are connected to form a half-wave rectified dc source for Relay K11.

Paper Start Switch

The PAPER START SWITCH is a microswitch that provides ac power to the Paper Advance Motor (M4).

S2 11" Print Button

This switch is a momentary contact switch that initiates the 11" PRINT cycle.

S7 14" Print Button

This switch is a momentary contact switch that initiates the 14" PRINT cycle. The operation of relay contacts K1-B, K2-B, K2-A, K7-B, K7-C, and K19-A as well as S19 are described with respect to K1, K2, K7, K19, and S19. When TIMER-1 times-out, TAKE-OFF B is energized. The MOTOR RELAY, located on Module-A, supplies power to the DRIVE MOTOR (M) that turns the selenium drum. Note that TAKE-OFF A has energized the MOTOR RELAY through Module-A, pin 4 and the closure of S17 complete the ac circuit through the MOTOR RELAY through Module-A, pins 3 and 2. TAKE-OFF B also supplies ac power to the copy counter CTR 1 and TIMER-2. TIMER-2 is a solid-state ac time delay network and its primary function will be described later.

K18 Stepper Isolating Relay

K18 is a two-section relay. The coil of this relay is energized when S17 closes. At all other times K18 is de-energized preventing coil K11 from responding to spurious impulses. Contacts K18-A supplies ac power to Module-B, pin 9 and contacts K18-B supplies ac power to the common (wiper) of S13. Pin 10 of Module-B completes an ac circuit (through a relay on Module-B) to K17-B and K11A. Ac power is also connected to S19-6 through K17-C.

S10 Advance or Quad-Cam Switch

Single-pole double-throw switch. This switch is activated by a four lobe cam each time a ½" of paper is fed. Each activation of S10 is detected by Module-B where the signal is digitally shaped, controlled, and fed to K11 coil opposite K11's dc source. The connection is arranged so that each closure of S10 advances the common (wiper) of S13 exactly one step.

R13 and C6-5

R13 and C6-5 are arc suppressors for Section K11-A pins 1 and 2. At this point the copier has been plugged-in and "VENDED" and is now prepared to make either an 11" or 14" copy. For either copy length, relay K2 will be energized. As previously mentioned, many events occur during the PRINT cycle. Therefore, the PRINT cycle will be described in a logical manner but not necessarily in sequential order.

K2 Print Start Relay

K2 is a three-section relay. The coil of this relay is energized by the 11" PRINT SWITCH (S2) through K8-A or by the 14" PRINT SWITCH (S7) through K5-C. Section K2-A will hold the coil of K2 energized. Section K2-B provides ac power to several relay sections. It is evident that K2 will be energized for either PRINT cycle, i.e., PRINT 11" or PRINT 41-. Section K2-C is of no consequence. Assume that the unit has been plugged-in, "VENDED," and either the PRINT 11" or PRINT 14" switch closed. Let's also assume the PRINT 11" switch has been closed. For this condition, K2 has been energized as well as Relay K8. Relay K4 has also been energized.

K4 Scanner Relay

K4 is a three-section relay. The coil of this relay is energized by the scanner limit switch S5 after a PRINT switch is closed. Section A of Relay K4 will latch the coil of K4 ON after the scanner leaves S5's position. Section B of this relay will supply the ac neutral line (cold side) to the +24 V dc power supply during the forward motion of the scanner. The forward motion of the scanner is the scanner's traveling distance from switch S5 to switch S4. The reverse motion of the scanner is the scanner's traveling distance from switch S4 back to switch S5. The scanner will not leave its "S5" position until the +24v dc POWER SUPPLY receives its ac input signal and a ½ second DELAY TIMER has timed-out. The POWER SUPPLY and DELAY TIMER are on Module-A. Section C of relay K4 is of no consequence. Another relay that is energized during the PRINT cycle is K5.

K5 Scanner Control Relay

K5 is a three-section relay. The coil of this relay is energized by the B sections of Relays K3 and K4. Section A of this relay is of no consequence, but Section B completes a redundant source to the EXPOSURE LAMP network to insure completion of the exposing cycle even if the PRINT cycle is inadvertently interrupted. Section C allows the PRINT cycle to begin only if the scanner is against one of the limit switches S4 or S5.

The printer's EXPOSURE LAMPS cannot reach full brilliance instantaneously and similarly the HIGH-VOLTAGE CHARGING POWER SUPPLY requires a definite period of time to stabilize. Therefore, a solid-state dc time delay prevents the FORWARD CLUTCH from engaging the SCANNER 28 and 38 until the EXPOSURE LAMPS 24 and CHARGING POWER SUPPLY are in the proper condition to reproduce a bond-copy.

When a dc voltage is initially applied to the circuit both of the active devices, QA-4 and QA-5 are in the OFF condition. Therefore, dc current cannot flow through the FORWARD CLUTCH and the CLUTCH is effectively inoperative. However, a small charging current does flow through the CLUTCH (not nearly large enough to engage the CLUTCH) and RA-8 and charges capacitor CA-6 at a rate determined by (RA-6) (CA-6). When the charging voltage measured across CA-6 reaches the intrinsic standoff voltage of the uni-junction transistor QA-4 (typically 55% of the voltage impressed across the device), the transistor "breaks-down" and current flows through the device. When current flows through QA-4 a positive impulse of voltage is generated across RA-9. This impulse is impressed on the gate (G) of the low gate current sensitive (200 UA) silicon controlled rectifier QA-5. As a result, the controlled rectifier also "breaks-down" presenting a very low impedance to ground for the FORWARD CLUTCH. DC current can now flow through the CLUTCH and the CLUTCH will engage the SCANNER.

It is important that this delay period be equal for every application of the printing cycle, even if rapid repeated single copies are required. Only in this manner can it insure that the printer's circuits are stable. Therefore, the charging resistor RA-8 is connected to the anode of the silicon-controlled rectifier QA-5. When the rectifier "triggers", the anode is essentially shorted to ground and the charging resistor RA-8 also returned to ground. The charging capacitor CA-6 now can discharge through RA-8 to ground. This guarantees that any residual voltage measured across the capacitor CA-6 is completely discharged before another print-cycle begins. Thus, the necessary delay time is exactly the same for every cycle of printing.

The diode DA-7 protects the silicon-controlled rectifier QA-5 from receiving a high negative transient "spike" of voltage when the CLUTCH turns OFF.

The +24 V dc POWER SUPPLY also receives ac power after the PRINT switch is closed. However, the FORWARD CLUTCH will not receive its dc voltage and it will not move the scanner 28 and 38 for approximately 0.5 seconds. This allows the CHARGING POWER SUPPLY and the EXPOSURE LAMP to reach their maximum effectiveness. Many events have occurred prior to engaging the FORWARD CLUTCH and moving the scanner 28 and 38 from its S5 position toward the S4 position.

TIMER 2 does not "time-out" for approximately 3.0 seconds. This 3.0 second period is the selenium drum's cleaning interval. Cleaning begins the instant TIMER 2 receives ac power.

Triac A Exposure Control Triac

Triac A is a Triac rated at 30 amps. The gate of Triac A is energized through capacitor C20 and the contacts of the CLEANER DELAY RELAY which is part of TIMER 2 located on MODULE-A (See FIG. 13) Trica A turns ON the EXPOSURE LAMP 413.

Charge Power Supply

This power supply has an output voltage of plus 6400 vdc and is applied to a corona wire in the charger bracket.

T3 Anti-Spike Transformer

This transformer is used to create a negative-going boost voltage to exactly match the voltage drop in the ac HOT LINE supplying the coils of relays K1, K2, K3, K4 and K8. Resistor R5 applies the proper damping to shape and size T3's output pulse. If this transformer was not used, the line voltage drop would be great enough to "drop-out" the above mentioned relays.

K8 Relay

K8 is a three section relay. The coil of this relay is energized by the 11" PRINT SWITCH. Section A latches K8 ON during an 11" copy cycle and it will maintain this latched condition until the unit times-out and turns itself off. Section B of K8 determines if an 11" or a 14" copy will be produced. Section C of K8 determines which motor coast (10½" or 13½") position is being used and energizes K19 accordingly. This removes ac power from the PAPER ADVANCE MOTOR.

S4 Scanner Switch

S4 receives ac power when K2 is energized for PRINT. When it is closed by the scanner, S4 will activate relay K3.

S5 Scanner Switch

S5 receives ac power when K2 is energized for PRINT. It is closed by the scanner at the beginning of each copy cycle. It also energizes relay K4.

To briefly recap the operations that have been discussed to this point: (1) The unit has been plugged-in, (2) the unit has been VENDED, and (3) the PRINT 11" switch has been depressed. The scanner has not yet begun its lateral scanning motion from switch position S5 to switch position S4.

(1) Initial distribution of power takes place immediately after the unit is plugged-in.
(2) at "VEND"
  a. K1 latches ON
  b. TIMER 1 (M2) receives ac power
  c. TIMER 1 "times-out"
    1. TIMER 2 activated
    2. The Driver Motor is turned ON
    3. The Bias Power Supply is turned ON
(3) For PRINT 11"
  a. Relay K8 is ON (energized for 11" only)
  b. Relay K2 is ON
  c. Relay K4 is ON
  d. Relay K5 is ON
  e. +24 vdc power supply turns ON
  f. The exposure lamp is turned ON
    1. after a ½ second delay, the FORWARD CLUTCH receives dc power and the scanner is about to begin its lateral motion.

As the scanner leaves switch position S5 and begins its scanning cycle, it closes the PAPER START switch. When this switch closes, the PAPER ADVANCE MOTOR is energized. As the paper advances S-10 will be activated energizing K11 and thereby advancing the Stepper Switch S13.

K11 Stepper Relay

The coil of this relay is energized each time the microswitch S-10 is closed by the advancing paper. The signal from S-10 is controlled and shaped by MODULE-B.

Assume 8" of paper have been prefed, by a previous print cycle. The prefeed will be explained later. If an 11" copy has been selected, then S13 will reach the CUT position after and additional 3" (equal to six S-10 pulses) of paper has been advanced. Or, if a 14" copy has been selected then S13 will reach the CUT position after an additional 6" (equal to twelve S-10 pulses) of paper has been advanced.

K19 Motor Coast Relay

The coil of K19 is energized when the wiper of S13 touches the 10½" or 13½" Motor Coast contacts of the stepper, depending on the position of K8. As the relay pulls in the Advance Motor, M4 loses power and awaits the application of the dc breaking voltage as it "coasts" down. Meanwhile, the "coast" allows S10 to energize the stepper which moves one more position to complete the circuit to K8B, allowing K7 to energize and apply the brake to M4.

The scanner, meanwhile, closes S4 energizing K3. This begins the reverse scan. When the reverse scan starts, K3 will remain energized, relay K4 will de-energize, the clutch-relay drops out, relay K5 will be energized, the Charging Power Supply will turn OFF, Triac A will turn off and the Reverse Clutch will pull-in.

K3 Scanner Relay

K3 is a three-section relay. The coil is energized by the scanner limit switch S4. Section A will latch K3 coil ON during return motion of scanner. Section B will supply the ac HOT LINE to the +24 vdc power supply during the forward motion of the scanner and the ac NEUTRAL LINE to the +24 vdc power supply during the reverse motion of the scanner. As the scanner leaves S4's position and begins its lateral motion back to S5's position, there is not an immediate change in the unit's status.

M4 Paper Advance Motor

The Paper Advance Motor is a shaded pole motor. This motor drives the paper advance rollers under the following conditions:

Paper Feed:

1. S8 in its normally "at rest" position
2. K7 de-energized
3. K19 de-energized
4. Paper Start Paper Load:

1. S12 in its normally closed position, i.e., the doors are open
2. S9 in its normally open position (button depressed)
3. S8 in its normally closed position At this point, the dc braking circuit is fully charged and prepared to supply the braking potential to the Paper Advance Motor M4.

D2, R11, R12, C4, and C5 PAPER ADVANCE MOTOR (M4) Braking Circuit

The diode D2 provides half-wave rectified ac to charge capacitors C4 and C5. At the same time, D2 prevents the charges accumulated on C4 and C5 from being released back through the Motor M4. Resistor R11 limits the maximum charging current available to C4 and C5, preventing the burning of contacts K7B or the destruction of D2 that could result from high currents. Resistor R12 slowly drains off the charge on C4 and C5 when power is shut off to help reduce the possible shock hazard to personnel. When K7 is energized, power to M4 is cut and the charges on C4 and C5 are dumped through K7B and the Advance Motor M4, thus bringing the Motor to a rapid halt. When K7 is energized dc braking voltage is applied to M4.

The unit has reached the MOTOR COAST position in reproducing a BOND copy. K19 is the MOTOR COAST relay. In the MOTOR COAST position, ac power is removed from the PAPER ADVANCE motor M4 and dc braking voltage is about to be applied to the motor.

As previously stated, K3 is energized and K4 is not energized as the scanner begins its lateral return to its starting position. Shortly after the scanner leaves S4-s position (the forward limit switch), the scanner engages the BIAS SWITCH. When the BIAS SWITCH closes, the voltage on the toner-tank plate is reversed to −450 AC and the plate is cleaned.

Meanwhile, S13 advances from its coast position to its braking position by Module-B sensing S10 closures. (For an 11" bond copy, the coast position is designated 10½; for 14" bond copy, the coast position is designated 13½). When the stepping Switch, S13, reaches the 11" or 14" position, ac power is coupled to the CUT RELAY-K7.

K7 Cut Relay

K7 is a three section relay. The coil of this relay is energized by the 11" or 14" contacts of S13 when the *common* of S13 is directly connected to those contacts.

Section A supplies running voltage to the Knige Motor M3 and to the Dole Valve Solenoid (Sol 3). Section B supplies running and braking voltage to the Advance Motor M4. Section C carries power to the 11" and 14" Print Buttons S2 and S7. K7's function is to break the print sequence line during the knife cut. This prevents the possibility of allowing another print cycle if a print button is depressed during the cut cycle.

Knife Switch (S6) was briefly described in a preceeding section of this disclosure. Section A is used to latch K1 in its normally open position; Section B (with Section A) completes the circuit that returns the Cut Motor M3 to its home position.

K17 Stepper Control Relay

The coil of K17 is energized briefly by a pulse from S6 when ever the Knife Motor closes S6. Contacts 5 and 6 of S18 latch K17 on until Stepper Switch S13 reaches its "home" position. Section A provides power to K11 for the rapid "homing" and Section B provides power to K11 when S10 closes. S6 is closed only momentarily by the knife. When S6 opens, K1 (that has been "latched" on) will drop out. Note when S6 opens ac power will be removed from the coil of K1 via Section A. Now that K17 is energized the stepper switch will rapidly return to its home position. The electrical action of this switch returning to its home position is very similar to the electrical action of a common "doorbell."

S13 Stepper Switch

S13 is a rotary switch and will register each half inch of paper by moving forward one position every time S10 closes. The common of S13 receives ac power from S17 through K18B.

The contacts of S18 (3 to 4 and 5 to 6) are closed and therefore the coil of K11 will be energized by the ac-hot-line connected through S18, 3 to 4. However, as soon as ac is applied to the coil of K11 the contacts of K11-A (1 to 2) are forced open removing the ac voltage from K11. Contacts 1 and 2 of K11-A are now free to close one one-another and the cycle repeats. The K11-A contacts continue to MAKE and BREAK rapidly "homing" the stepper switch S13. After S13 has homed, K7 and K19 are de-energized because these coils receive ac power from contacts of S13.

As the scanner contacts S4, ac power is once again supplied to the PAPER ADVANCE motor. As the paper advances, S10 and the isolation amplifiers (on Module B) once again track the paper's motion. For every one-half inch of the paper's forward motion, the stepper switch (S13) advances exactly one position.

When the stepper switch connects ac power to the MOTOR COAST RELAY (K19) the PAPER ADVANCE MOTOR turns OFF. The unit has now fed exactly 8" of bond paper for the next printing cycle. The amount of bond paper prefed is a function of the interconnections on the Stepper Switch S13.

This foregoing explains the prefeed of the bond paper. Whether the copy is 11" or 14" in length depends on exactly when the CUT cycle is attained. After S13 homes and K1 is de-energized by S6, the solid-state shut-off timer (T.D.) is activated.

Meanwhile, the scanner has returned to its initial starting position. S5 is closed by the scanner energizing K4 and de-energizing K5. Relay coil K2 is energized as is relay coil K18. All of this circuitry plus some additinal relay coils are energized and holding until the solid-state shut-off timer T.D. times-out the unit. In a few seconds, the solid-state timer activates S20 and ac power is applied to K10. K10 is mechanically "linked" to S21 and forces S21 open interrupting ac power to the unit and the unit shuts off.

Before concluding this description there are several electrical components and secondary relays that will be described.

K12 Charger Cutout Relay

K12 is a thermal delay relay. The element of this relay is energized whenever the FORWARD or REVERSE CLUTCH is on. The contacts of this relay open the circuit from relays K1, K2, K3, K4, and K8 if the clutches are energized for more than 30 seconds. The purpose is to prevent the clutches from burning out should a malfunction occur.

S19 Double Charge Switch

S19 is a single-pole double-throw switch. For this unit it is in position D, i.e., C is closed on D.

C9, C10, C11, C13

These capacitors are used as arc suppressors for various relay contacts. The master schematic diagram shows the location of these capacitors.

L1-11" Print Light

L1 is a neon indicator. This lamp is part of the 11" PRINT BUTTON. It indicates when the unit is ready to make a 14" copy by lighting up.

L3 Empty Light

L3 is an incandescent lamp. This lamp is on whenever S3 or S11 switch over to indicate that the unit is either out of toner or out of paper.

Copy Counter 2—Vend Counter

This counter is a 5-digit counter and will advance a single "count" each time the VEND switch is closed.

K9 CREM Control Relay

K9 is a two section relay. The coil of the relay is energized by S21. Section A opens the circuit to the CREM coil whenever the unit is ON. Section B controls the negative boost from T3 to the coil of K1 and K2, preventing this relay from chattering or dropping out when the unit is turned ON with the free play switch S14.

The scanner physically contacts four (4 ) control switches when a bond copy is produced. They are S4, S5, the PAPER START SWITCH, and the BIAS SWITCH. Collectively, these switches control the distribution of ac power to relays K3 and K4, the PAPER ADVANCE MOTOR, and MODULE-A.

The mechanical elements removed from the prior art photocopy machine or retained therein have been identified in detail and the mechanical elements of the conversion kit have likewise been described. Similarly, the electrical items removed from the prior art photocopy machine or retained therein have also been described in detail and the rewiring of the retained items has been completely disclosed in this specification and in the drawings. The following is a detailed parts list of the significant items disclosed in FIG. 13 (Module-A) and FIG. 14 (Module-B).

MODULE-A
(FIG. 13)
LIST OF COMPONENTS

| Element No. | Part Specification |
|---|---|
| RA-1 | 50 ohm/5 watt resistor |
| RA-2 | 4.3 K ohm/½ watt resistor |
| RA-3 | 1.2 K ohm/¼ watt resistor |
| RA-4 | 2.0 K ohm/½ watt resistor |
| RA-5 | 1.1 K ohm/½ watt resistor |
| RA-6 | 1.1 K ohm/½ watt resistor |
| RA-7 | 2.2 K ohm/½ watt resistor |
| RA-8 | 300 K ohm/½ watt resistor |
| RA-9 | 47 ohm/½ watt resistor |
| RA-10 | 2 K ohm/1 watt resistor |
| RA-11 | 15 K ohm/2 watt resistor |
| RA-12 | 15 K ohm/2 watt resistor |
| RA-13 | 15 K ohm/2 watt resistor |
| RA-14 | 4.7 K ohm/½ watt resistor |
| RA-15 | 3.0 K ohm/½ watt resistor |
| RA-16 | 110 K ohm/¼ watt resistor |
| RA-17 | 1.0 K ohm/¼ watt resistor |
| RA-18 | 1 meg ohm/¼ watt resistor |
| RA-19 | 68 ohm/¼ watt resistor |
| RA-20 | 1 K ohm/¼ watt resistor |
| RA-21 | 100 ohm/½ watt resistor |
| CA-1 | 50 microfarad/50 volt capacitor |
| CA-2 | 50 microfarad/50 volt capacitor |
| CA-3 | 1.0 microfarads/50 volts capacitor |
| CA-4 | 10 microfarads/16 volt capacitor |
| CA-5 | 10 microfarad/50 volt capacitor |
| CA-6 | 1.0 microfarad/50 volt capacitor |
| CA-7 | 40 microfarad/450 volt dc capacitor |
| CA-8 | 10 microfarad/150 volt capacitor |
| CA-9 | 15 microfarads/50 volt capacitor |
| CA-10 | 0.015 microfarad/200 volt capacitor |
| DA-1 | 920A3 diode |
| DA-2 | 920A3 diode |
| DA-3 | 920A3 diode |
| DA-4 | 920A3 diode |
| DA-5 | No 1N914 |
| DA-6 | 52420/12 volt Zener diode |
| DA-7 | 1N4005 Diode |
| DA-8 | 1N5399 Diode |
| DA-9 | 1N5399 Diode |
| DA-10 | 1N5399 Diode |
| DA-11 | 1N525 Zener diode/24 volt |
| DA-12 | 1N4005 Diode |
| QA-1 | 2N3643 Transistor |
| QA-2 | 2N3643 Transistor |
| QA-3 | 2N5202 Transistor |
| QA-4 | 2N4891 Uni-junction transistor |
| QA-5 | 2N5061 Selenium control rectifier |
| QA-6 | 2N4891 Uni-junction transistor |
| QA-7 | 2N5061 Selenium control rectifier |
| RLA-1 | P.B. Type R10.E1-X4 Relay |
| RLA-2 | P.B. Type: E10.E1-X2 Relay |
| RLA-3 | P.B. Type: Z10.E1-X2/15 volt ac Relay |

MODULE-B
(FIG. 14)
LIST OF COMPONENTS

| Element No. | Part Specification |
|---|---|
| RPE-1 | 15 ohm/1 watt resistor |
| RB-2 | 4.3 K ohm/½ watt resistor |

-continued

| | |
|---|---|
| RB-3 | 1.2 K ohm/½ watt resistor |
| RB-4 | 2 K ohm/½ watt resistor |
| RB-5 | 1.2 K ohm/½ watt resistor |
| RB-6 | 620 ohm/1 watt resistor |
| RB-6.5 | 1.0 K ohm/½ watt resistor |
| RB-7 | 47 K ohm/¼ watt resistor |
| RB-8 | 75 K ohm/¼ watt resistor |
| RB-9 | 7.5 K/¼ watt resistor |
| RB-10 | 510 ohm/½ watt resistor |
| RB-11 | 3.9 K ohm/¼ watt resistor |
| RB-12 | 50 ohm/5 watt resistor |
| RB-13 | 100 K ohm/½ watt resistor |
| CB-1 | 50 microfarad/50 volt capacitor |
| CB-2 | 50 microfarad/50 volt capacitor |
| CB-3 | 1.0 microfarad/50 volt capacitor |
| CB-4 | 10 microfarad/16 volt capacitor |
| CB-5 | 10 microfarad/50 volt capacitor |
| CB-6 | 0.1 microfarad capacitor |
| CB-7 | 0.082 microfarad capacitor |
| CB-8 | 1.0 microfarad capacitor |
| CB-9 | 0.15 microfarad capacitor |
| CB-10 | 300 microfarad/300 volt dc capacitor |
| CB-11 | 300 microfarad/200 volt dc capacitor |
| DB-1 | 920A3 diode |
| DB-2 | 920A3 diode |
| DB-3 | 920A3 diode |
| DB-4 | 920A3 diode |
| DB-5 | 1N914 diode |
| DB-6 | 1N5231B Zener diode |
| DB-7 | 1N914 diode |
| DB-8 | 1N914 diode |
| DB-9 | 1N4005 diode |
| DB-10 | 2N5384B Zener diode |
| DB-11 | 1N5399 diode |
| QB-1 | 2N3643 transistor |
| QB-2 | 2N3643 transistor |
| QB-3 | 2N5202 transistor |
| QB-4 | 2N3439 transistor |
| QB-5 | 2N3638 transistor |
| UB-1 | Type 4099 Operational amplifier, Itex Buffer RCA |
| UB-2 | Type 4099 Operational amplifier, Itex Buffer RCA |
| UB-3 | Type 4099 Operational amplifier, Itex Buffer RCA |
| UB-4 | Type 4099 Operational amplifier, Itex Buffer RCA |
| UB-5 | Type 4099 Operational amplifier, Itex Buffer RCA |
| UB-6 | Type 4099 Operational amplifier, Itex Buffer RCA |
| UB-7 | Type CD 4047 AE Module, Low Power Monostable Vibrator RCA |

Figure 15A:
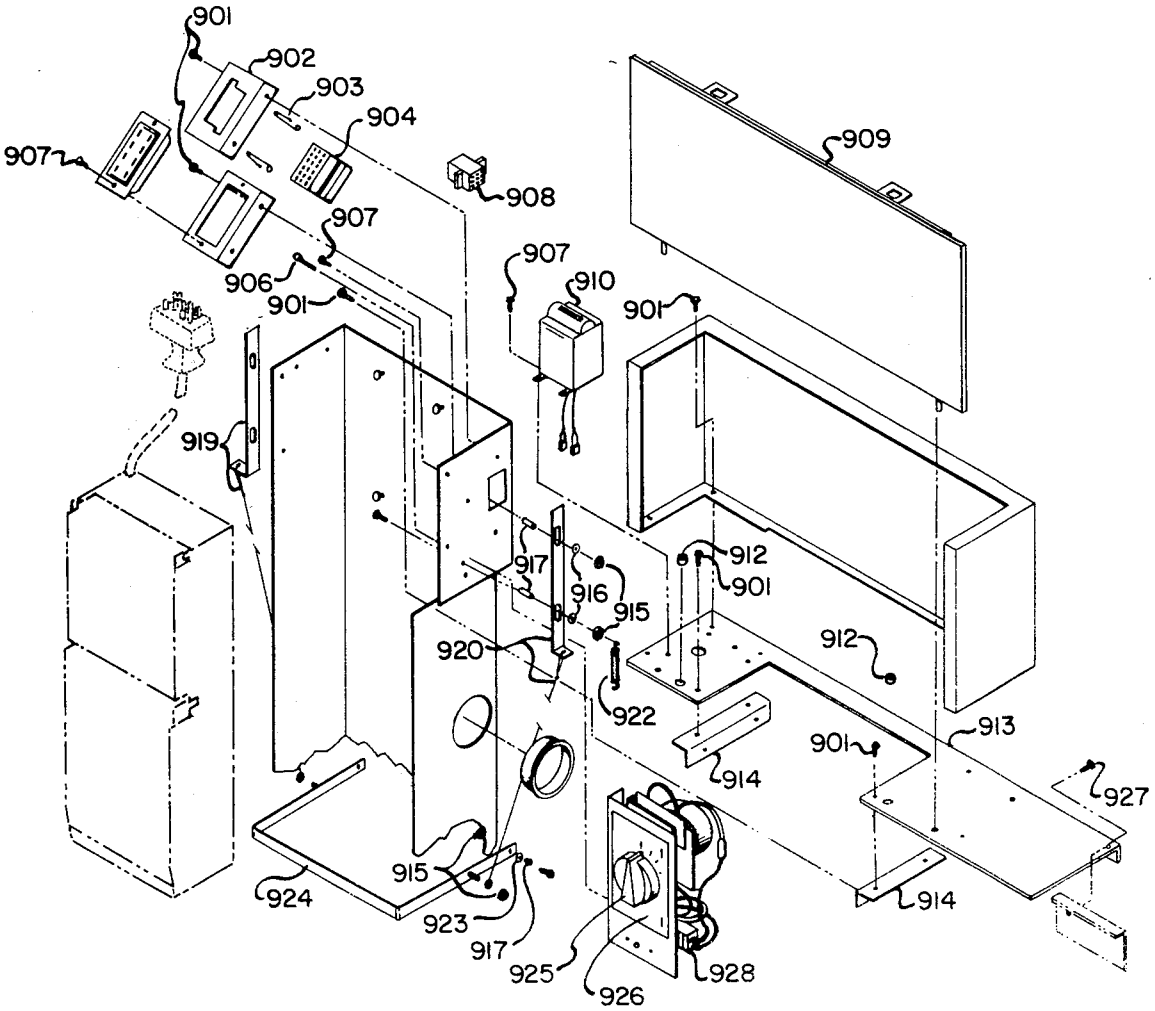
FIGS. 15A and 15B are exploded views of the coin mechanism found on both the prior art photocopiers of FIGS. 1, 2, 10 and 10B and on the converted machine.
Figure 15B:
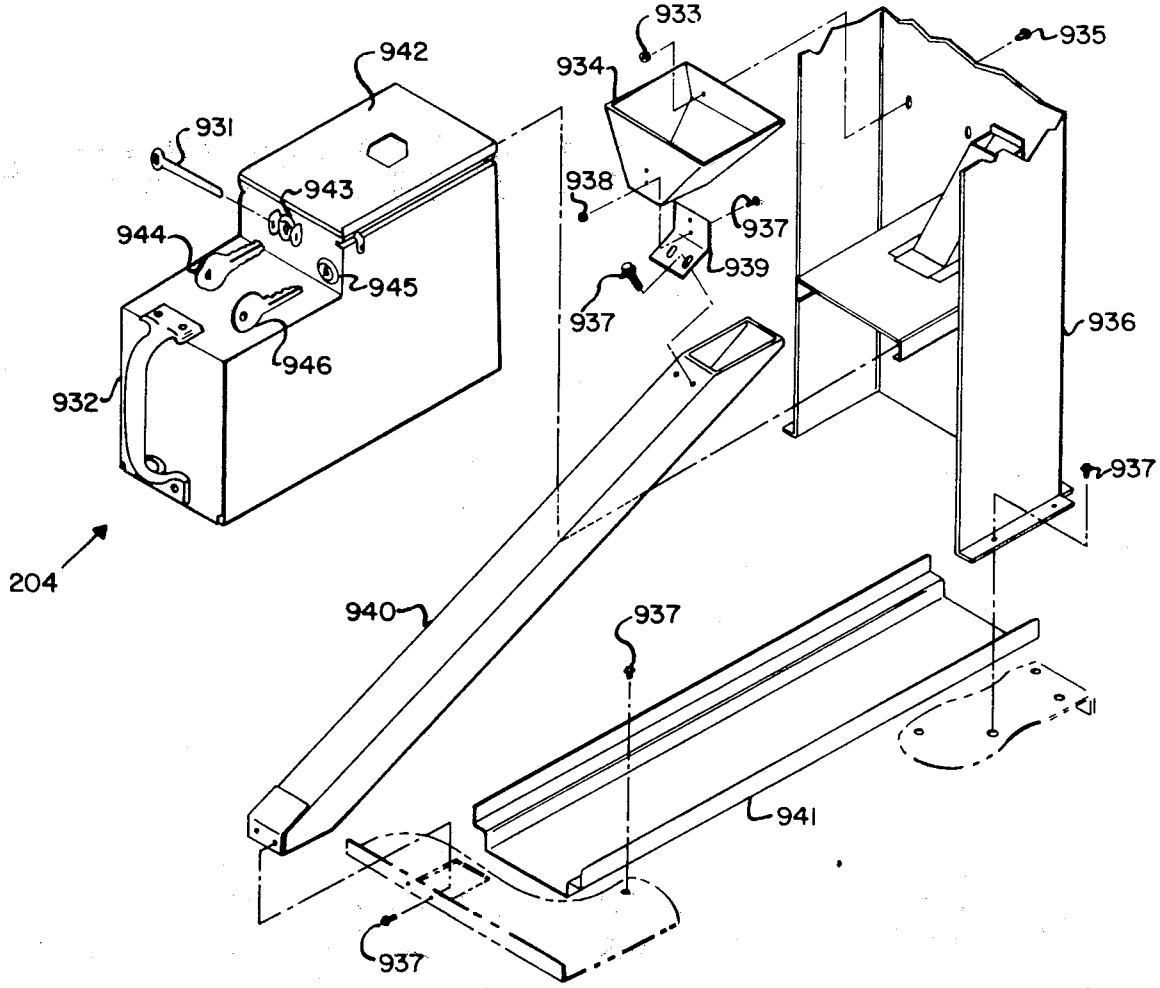

The coin mechanism 204 and 226 is illustrated in exploded detail in FIGS. 15A and 15B. The structure and function of the coin mechanism is essentially identical in the prior art Model 520 machine as well as in the converted machine. A complete description of the structure of this prior art element may be found along with a complete description of all prior art elements in the Olivetti Parts Catalog entitled "Coinfax-Model 520, 150 Volts—60 Cycles". The function of the prior art coin mechanism has previously been described with respect to the circuitry of the prior art circuit of FIGS. 10A and 10B and the conversion circuitry of FIGS. 12A, 12B, 13 and 14. Another prior art description can be found in the manufacturers original publications. A complete understanding of the coin mechanism is not necessary to an understanding of the present invention because the prior art coin mechanism is retained unchanged in the converted machine. Rather, this description of the coin mechanism is submitted merely to round out the disclosure and to illustrate some prior art features that may not be conspicuous from FIGS. 1, 2, 10A and 10B. The element of the coin mechanism illustrated in FIGS. 15A and 15B include the following:

COIN MECHANISM
(FIGS. 15A and 15B)
Parts List

| Element No. | Part |
|---|---|
| 901 | Screw |
| 902 | Bracket |
| 903 | Clip |
| 904 | Receptical |
| 905 | Bracket |
| 906 | Screw |
| 907 | Screw |
| 908 | Plug |
| 909 | Access Panel |
| 910 | Counter |
| 911 | Housing |
| 912 | Bushing |
| 913 | Support |
| 914 | Bracket |
| 915 | Nut |
| 916 | Washer |
| 917 | Bearing |
| 918 | Timer Motor Assembly |
| 919 | L/H Latch Assembly |
| 920 | R/H Latch Assembly |
| 921 | Gromet |
| 922 | Spring |
| 923 | Washer |
| 924 | Handle |
| 925 | Knob |
| 926 | Decal |
| 927 | Screw |
| 928 | Relay K9 |
| 931 | Coin Box Seal |
| 932 | Coin Box |
| 933 | Nut |
| 934 | Lip |
| 935 | Screw |
| 936 | Housing Assembly |
| 937 | Screw |
| 938 | Nut |
| 939 | Bracket |
| 940 | Chute |
| 941 | Coin Box Pail |
| 942 | Coin Box Lid |
| 943 | Lid Lock |
| 944 | Lid Key |
| 945 | Rail Lock |
| 946 | Rail Key |

Figure 16:
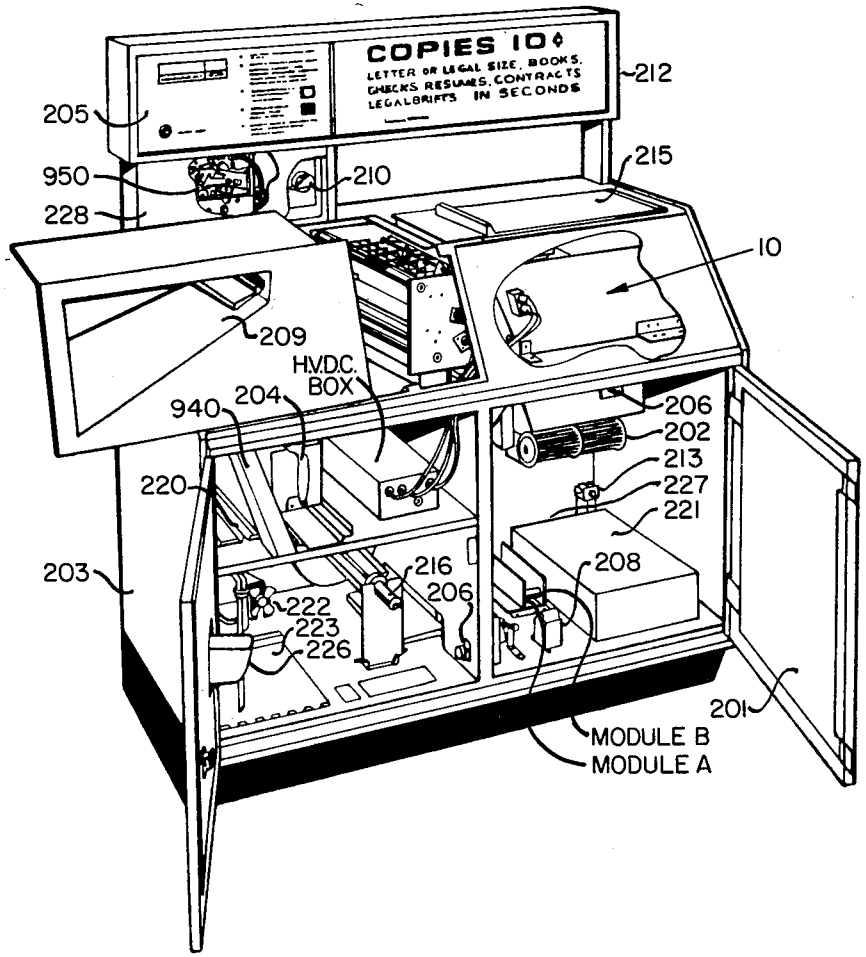
FIG. 16 is an interior perspective view of a converted photocopier.

The foregoing has described the Olivetti Model 520 Coinfax machine as the preferred starting embodiment of the prior art which is converted into a negative liquid toner bond paper copier. FIG. 16 is an interior perspective view of the photocopy machine after conversion by kit 10. It will be understood by those of ordinary skill in the art that other machines may be converted also, given the teaching in this disclosure. Specifically, this invention also comprehends the conversion of the following Olivetti Prior Art machines: 514, 515, 614, and 614R. The foregoing machines are well known to those of ordinary skill in the art. In addition to the foregoing other modifications could be made to the preferred embodiment without departing from the spirit and scope of the general invention.

I claim:

1. A conversion apparatus for converting a conventional, Olivetti® brand, prior art, coated paper, roll fed, positive liquid toner photocopying machine of the type including at least a large console-like chassis, and air blower means, a coin feed mechanism, an electronic control system, a power supply, a photosensitive drum, a negative voltage transfer means, an optical system, a paper roll feed mechanism including a paper spindle, a paper cutting knife means, reflector and lamp assemblies, a liquid toner pump, a liquid toner reservoir, a conveyor, a transport, turn-around guide elements, a corona bracket, a motor, processor and toner tray, a flap and solenoid assembly, and a heater element into a negative liquid toner, plain paper, roll fed photocopying machine, said conventional prior art photocopying machine retaining at least said chassis, said paper roll feed mechanism, said paper cutting knife means, said liquid toner pump, said liquid toner reservoir and said coin feed mechanism, said conversion apparatus comprising a combination of the following elements:

a frame receivable for mounting in the chassis of said conventional photocopying machine;

an image projection system for projecting an image of the object to be duplicated, said image projection system being mounted on said frame;

a drum means mounted on said frame for receiving said image;

a drum drive means;

a liquid pump system including a toner delivery tray for providing negatively charged liquid toner to said drum, said tray being attached to said frame and connected to said liquid toner pump and said liquid toner reservoir;

a positive voltage transfer means mounted on said frame for transferring negatively charged toner from said drum to paper from said paper roll feed mechanism; and, an electronic control circuit means for controlling the elements of the converted machine, wherein said foregoing elements of said conversion apparatus are installed as a unit in said chassis of said conventional photocopying machine.

2. The apparatus of claim 1 wherein said drum drive means comprises:

an electric motor;

a chain drive means connected to said motor;

a sprocket adapted for connection with said chain drive means; and, a drum mounting means connected to said sprocket.

3. The apparatus of claim 2 wherein said drum mounting means comprises:

a drum shaft connected to said sprocket; and, a pair of drum end caps for rigidly connecting said drum to said shaft.

4. The apparatus of claim 3 further including a motor clutch means.

5. The apparatus of claim 4 further including:

a plurality of pick-off fingers for removing paper from said drum.

6. The apparatus of claim 5 wherein said pick-off fingers are mounted on a shaft connected to said frame.

7. The apparatus of claim 6 wherein the pick-off fingers comprise triangular-shaped plastic elements.

8. The apparatus of claim 7 wherein said toner tray includes an electrically conductive, metallic trough, and, said liquid pump system includes an overflow means for removing excess liquid toner from said toner tray and recirculating it back to said liquid toner reservoir.

9. The apparatus of claim 8 further including a perforated pipe means having a plurality of apertures therein connected to said pump for delivering the liquid toner evenly into said toner tray, wherein the overflow from said toner tray is removed from both ends thereof.

10. The apparatus of claim 9 further including:

a delay means for activating a photoelectric scanning unit.

11. The apparatus of claim 1 wherein the elements of said kit are reversed 180° from conventional negative liquid toner photocopying machines so that when said prior art machine is converted the photocopies are delivered on the lefthand side of the converted machine when seen from the front.

12. A conversion method for converting a conventional Olivetti ® brand, prior art, coated paper, roll fed, positive liquid toner photocopying machine of the sort including at least a large console-like chassis, an air blower means, a coin feed mechanism, an electronic control system, a power supply, a photosensitive drum, a negative voltage transfer means, an optical system, a paper roll feed mechanism including a paper spindle, a paper cutting knife means, a conveyor, a transport, turn-around guide elements, a corona bracket, a motor, processor and toner tray, reflector and lamp assemblies, flap and solenoid assembly, a liquid toner pump, a liquid toner reservoir and a heater element into a negative liquid toner, plain paper, roll fed, photocopying machine, said method comprising at least the steps of:

removing from said prior art machine said conveyor, power supply, processor and toner tray, reflector and lamp assemblies and turn-around guide elements;

removing said air blower means from said prior art machine;

at least partially removing said flap and solenoid assembly, optical system, corona bracket and motor assemblies;

installing into the chassis of said prior art machine a conversion apparatus, said conversion apparatus comprising at least a frame, an image projection system, a drum means, a drum drive means, a liquid pump system including a toner delivery tray means for providing negatively charged liquid toner to said drum means, a positive voltage transfer means, and an electronic control circuit means for controlling the elements of the converted machine, said apparatus elements comprising a unit which is receivable in said chassis of said conventional prior art photocopying machine; and, remounting said air blower means below said conversion apparatus frame so that said air blower means blows upwardly into the region of said conversion apparatus frame.

* * * * *